US009561648B2

(12) United States Patent
Sekiguchi et al.

(10) Patent No.: US 9,561,648 B2
(45) Date of Patent: Feb. 7, 2017

(54) LIQUID EJECTION APPARATUS

(71) Applicant: Brother Kogyo Kabushiki Kaisha, Nagoya-shi, Aichi-ken (JP)

(72) Inventors: Yasuhiro Sekiguchi, Nagoya (JP); Yuichi Ito, Mie-gun (JP); Tomohiro Nodsu, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/085,423

(22) Filed: Mar. 30, 2016

(65) Prior Publication Data

US 2016/0288495 A1 Oct. 6, 2016

(30) Foreign Application Priority Data

Mar. 31, 2015 (JP) ..... 2015-074655

(51) Int. Cl.
*B41J 2/045* (2006.01)

(52) U.S. Cl.
CPC ..... *B41J 2/04588* (2013.01); *B41J 2/04586* (2013.01)

(58) Field of Classification Search
CPC . B41J 2/04541; B41J 2/04581; B41J 2/04586; B41J 2/04588; B41J 2/04591; B41J 2/04596; B41J 2/165; B41J 2002/16502
See application file for complete search history.

(56) References Cited

U.S. PATENT DOCUMENTS

| | | | | |
|---|---|---|---|---|
| 5,541,628 | A | 7/1996 | Chang et al. | |
| 6,386,664 | B1 | 5/2002 | Hosono et al. | |
| 6,431,674 | B2 * | 8/2002 | Suzuki | 347/10 |
| 6,715,852 | B2 * | 4/2004 | Yonekubo | B41J 2/04551 347/10 |
| 8,020,955 | B2 * | 9/2011 | Shibata | B41J 2/04541 347/11 |
| 2012/0306956 | A1 | 12/2012 | Kimura et al. | |

FOREIGN PATENT DOCUMENTS

| | | | |
|---|---|---|---|
| JP | H03-164258 | A | 7/1991 |
| JP | H07-137252 | A | 5/1995 |
| JP | H11-314360 | A | 11/1999 |
| JP | 3319733 | B2 | 9/2002 |
| JP | 2013-014130 | A | 1/2013 |

* cited by examiner

*Primary Examiner* — Anh T. N. Vo
(74) *Attorney, Agent, or Firm* — Banner & Witcoff, Ltd.

(57) ABSTRACT

A liquid ejection apparatus stores ejection pattern information and slight vibration pattern information indicating two-dimensional arrangements of ejection information and slight vibration information, respectively. A controller transmits an ejection signal when the ejection information at a first position in the ejection pattern information is first information and when the slight vibration information at a second position in the slight vibration pattern information is third information or fourth information. The controller transmits a slight vibration signal the ejection information at the first position is second information and when the slight vibration information at the second position is the third information. The controller transmits a non-vibration signal when the ejection information at the first position is the second information and when the slight vibration information at the second position is the fourth information.

10 Claims, 17 Drawing Sheets

LIQUID EJECTION APPARATUS

CROSS REFERENCE TO RELATED APPLICATION

The present application claims priority from Japanese Patent Application No. 2015-074655, which was filed on Mar. 31, 2015, the disclosure of which is herein incorporated by reference in its entirety.

BACKGROUND

Technical Field

The following disclosure relates to a liquid ejection apparatus configured to eject liquid from nozzles.

Description of the Related Art

There are known ink-jet recording apparatuses including a carriage and a recording head mounted on the carriage, and configured to control the recording head to eject ink droplets from nozzles of the recording head while moving the carriage in a main scanning direction. A first example of the ink-jet recording apparatuses creates dot pattern information for one line, store the created dot pattern information into an output buffer, and then set a recording start position that is a position at which ink is to be ejected first in a printing area corresponding to the one line. The ink-jet recording apparatus then sets a slight-vibration start position based on the recording start position. The slight-vibration start position is a position at which slight vibration of a meniscus of ink is to be started. When the created dot pattern information is transferred to a recording head, the recording head is reciprocated. The meniscus is slightly vibrated in conjunction with this reciprocation.

A second example of the ink-jet recording apparatuses performs printing by driving piezoelectric elements based on print pattern information to cause the recording head to eject ink droplets from its nozzles. In this ink-jet recording apparatus, the piezoelectric element is always driven to slightly vibrate ink in the corresponding nozzle except when the ink droplet is ejected from the nozzle.

SUMMARY

In the above-described first example, the slight-vibration start position is set based on the recording start position as described above. However, since the recording start position is changed depending upon the dot pattern information, complicated processings may be required for setting the slight-vibration start position.

In the above-described second example, the ink in the nozzle is always slightly vibrated except when the ink droplet is ejected from the nozzle. This operation may cause increase in power consumption, heat generation of the recording head, and deterioration of the piezoelectric element, for example.

Accordingly, an aspect of the disclosure relates to a liquid ejection apparatus capable of easily determining the timing when a meniscus of liquid in a nozzle is slightly vibrated, with reduced increase in power consumption, reduced heat generation of a liquid ejection head, and reduced deterioration of an actuator.

In one aspect of the disclosure, a liquid ejection apparatus includes: a liquid ejection head having a plurality of nozzles and a plurality of actuators respectively corresponding to the plurality of nozzles; a storage configured to store ejection pattern information and slight vibration pattern information, the ejection pattern information indicating a two-dimensional arrangement of ejection information that is any one of first information and second information, the first information indicating that the liquid ejection head is to eject liquid from one of the plurality of nozzles, the second information indicating that the liquid ejection head is not to eject liquid from one of the plurality of nozzles, the slight vibration pattern information indicating a two-dimensional arrangement of slight vibration information that is any one of third information and fourth information, the third information indicating that a meniscus of the liquid is to be slightly vibrated, the fourth information indicating that the meniscus of the liquid is not to be slightly vibrated; and a controller configured to transmit one drive signal to at least one of the plurality of actuators among a plurality of kinds of drive signals based on the ejection pattern information and the slight vibration pattern information stored in the storage. The controller being configured to perform: when the ejection information at a first position in the ejection pattern information is the first information and when the slight vibration information at a second position in the slight vibration pattern information is one of the third information and the fourth information, transmitting an ejection signal, for instructing ejection of the liquid, to a first actuator that is one of the plurality of actuators which corresponds to the first position, the second position being a position in the slight vibration pattern information which corresponds to the first position; transmitting a slight vibration signal to the first actuator when the ejection information at the first position in the ejection pattern information is the second information and when the slight vibration information at the second position in the slight vibration pattern information is the third information, the slight vibration signal being a signal for instructing slight vibration of the meniscus of the liquid in one of the plurality of nozzles which corresponds to the second position; and transmitting a non-vibration signal to the first actuator when the ejection information at the first position in the ejection pattern information is the second information and when the slight vibration information at the second position in the slight vibration pattern information is the fourth information, the non-vibration signal being a signal for not instructing slight vibration of the meniscus of the liquid.

In another aspect of the disclosure, a liquid ejection apparatus includes: a liquid ejection head having a plurality of nozzles and a plurality of actuators respectively corresponding to the plurality of nozzles; a storage configured to store ejection pattern information and slight vibration pattern information, the ejection pattern information indicating a two-dimensional arrangement of ejection information that is any one of first information and second information, the first information indicating that the liquid ejection head is to eject liquid from one of the plurality of nozzles, the second information indicating that the liquid ejection head is not to eject liquid from one of the plurality of nozzles, the slight vibration pattern information indicating a two-dimensional arrangement of slight vibration information that is any one of third information and fourth information, the third information indicating that a meniscus of the liquid is to be slightly vibrated, the fourth information indicating that the meniscus of the liquid is not to be slightly vibrated; and a controller configured to transmit one drive signal to at least one of the plurality of actuators among a plurality of kinds of drive signals based on the ejection pattern information and the slight vibration pattern information stored in the storage. The controller is configured to perform: when the ejection information at first position in the ejection pattern information is the first information and when the slight vibration information at second position in the slight vibration pattern information is one of the third information and the fourth information, transmitting an ejection signal, for instructing ejection of the liquid, to a first actuator that is one of the plurality of actuators which corresponds to the first position, the second position being a position in the slight vibration pattern information which corresponds to the first position; transmitting a first slight vibration signal to the first actuator when the ejection information at the first position in the ejection pattern information is the second information and when the slight vibration information at the second position in the slight vibration pattern information is the third information, the first slight vibration signal being a signal for instructing slight vibration of the meniscus of the liquid in one of the plurality of nozzles which corresponds to the second position; and transmitting a second slight vibration signal to the first actuator when the ejection information at the first position in the ejection pattern information is the second information and when the slight vibration information at the second position in the slight vibration pattern information is the fourth information, the second slight vibration signal being a signal for slightly vibrating the meniscus of the liquid by a smaller amount than when the first slight vibration signal is transmitted.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

First Embodiment

Hereinafter, there will be described a first embodiment.

Overall Construction of Printer

Figure 1:
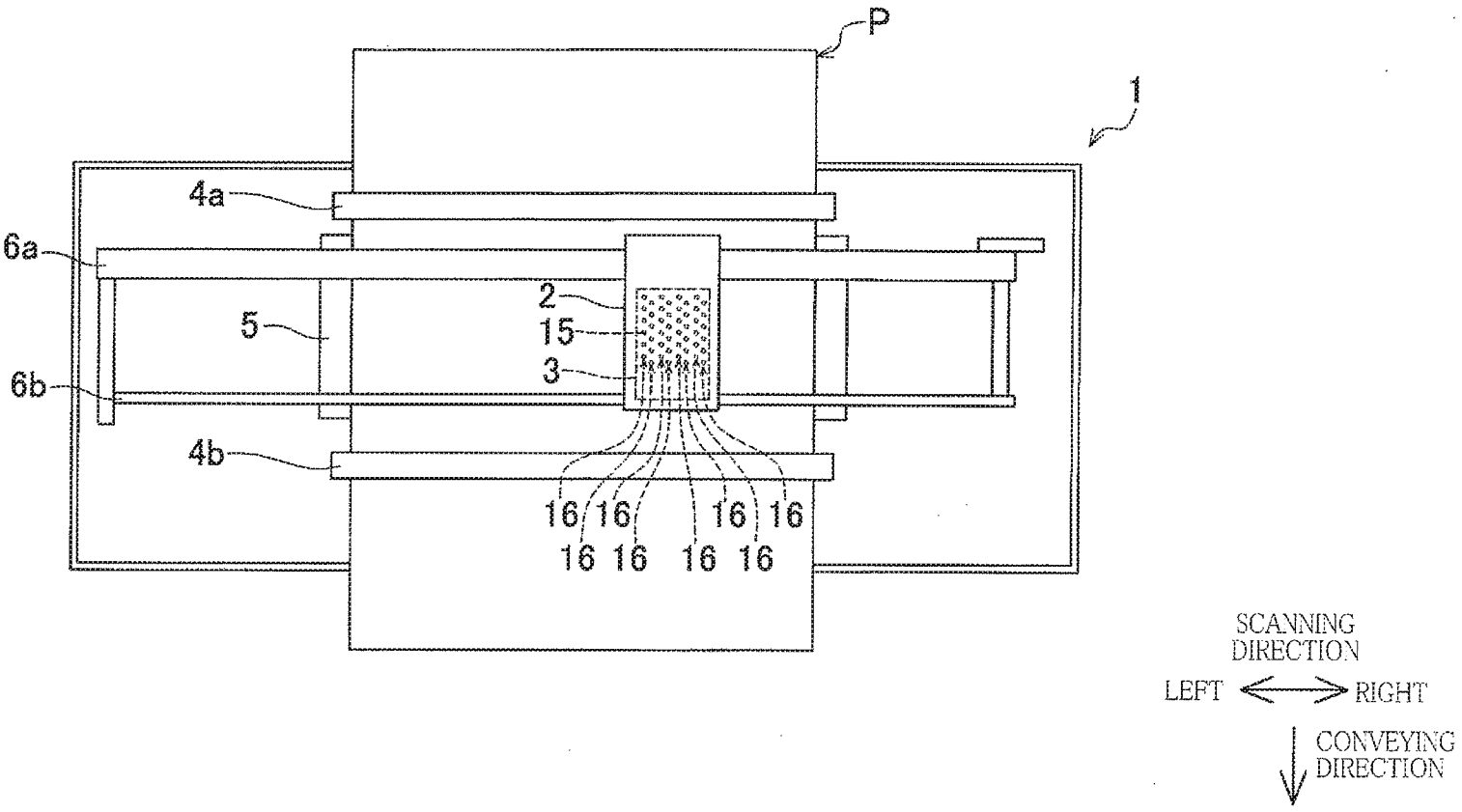
FIG. 1 is a schematic view of a printer according to a first embodiment.

As illustrated in FIG. 1, a printer 1 according to a first embodiment includes a carriage 2, an ink-jet head 3, conveying rollers 4*a*, 4*b*, and a platen 5. The carriage 2 is movably supported by guide rails 6*a*, 6*b* extending in a scanning direction. The carriage 2 is connected to a carriage motor 61 (see FIG. 3) via a belt and pulleys, not illustrated. The carriage 2 is driven by the carriage motor 61 so as to be reciprocated in the scanning direction. In the following description, the right and left sides are defined with respect to the scanning direction as illustrated in FIG. 1.

The ink-jet head 3 is mounted on the carriage 2 and ejects ink from a multiplicity of nozzles 15 formed in a lower surface of the ink-jet head 3. The conveying roller 4*a* is disposed upstream of the carriage 2 in a direction perpendicular to the scanning direction. The conveying roller 4*b* is disposed downstream of the carriage 2 in the direction perpendicular to the scanning direction. The conveying rollers 4*a*, 4*b* are connected to a conveying motor 62 and driven by the conveying motor 62 to convey a recording sheet P in a conveying direction. The platen 5 is disposed between the conveying rollers 4*a*, 4*b* in the conveying direction so as to be opposed to the ink-jet head 3. The platen 5 supports a lower surface of the recording sheet P conveyed by the conveying rollers 4*a*, 4*b*.

In this printer 1, ink is ejected onto the recording sheet P conveyed by the conveying rollers 4*a*, 4*b* from the ink-jet head 3 reciprocated in the scanning direction with the carriage 2, so that an image is printed on the recording sheet P.

Ink-Jet Head

Figure 2:
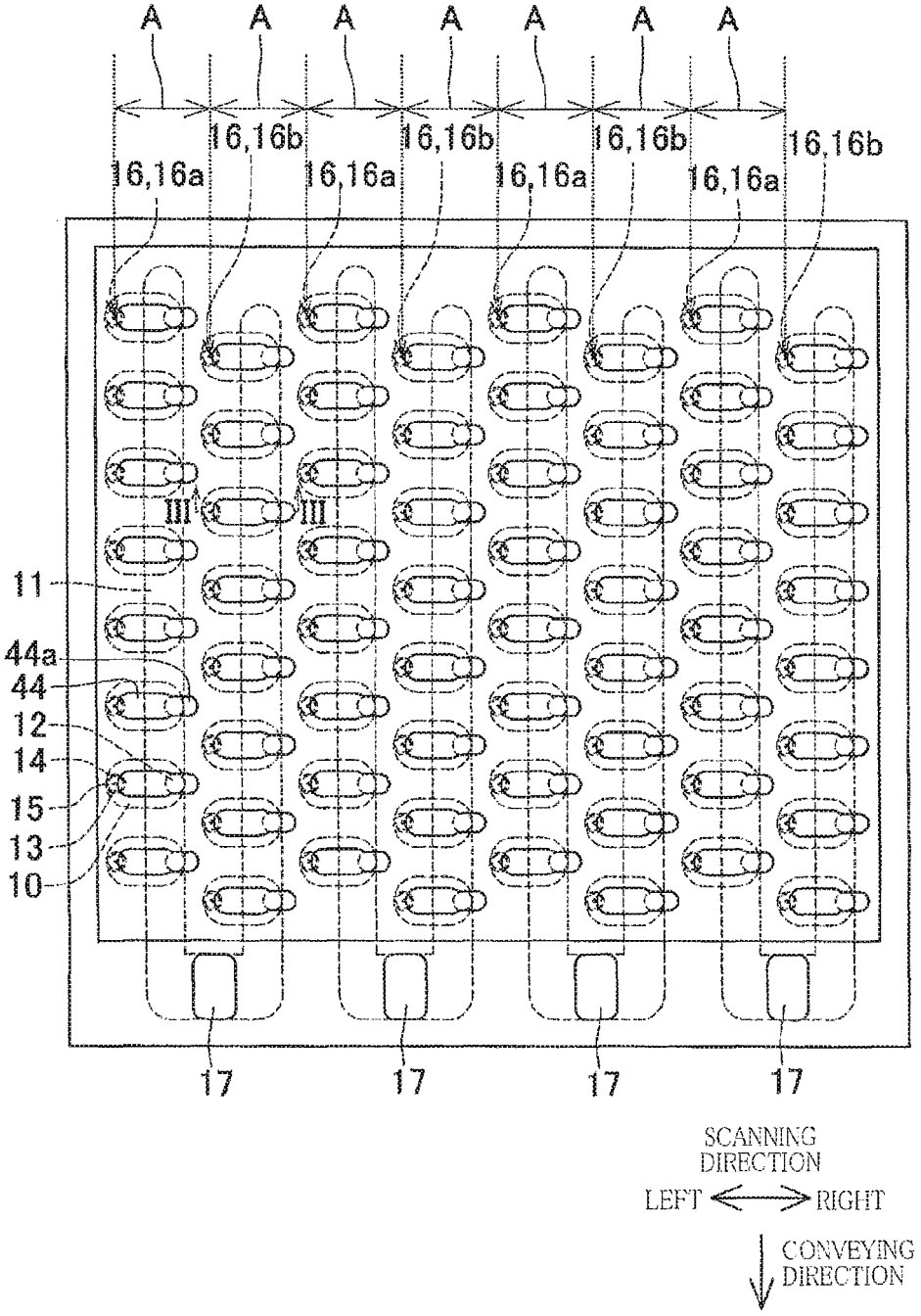
FIG. 2 is a plan view of an ink-jet head in FIG. 1.
Figure 3:
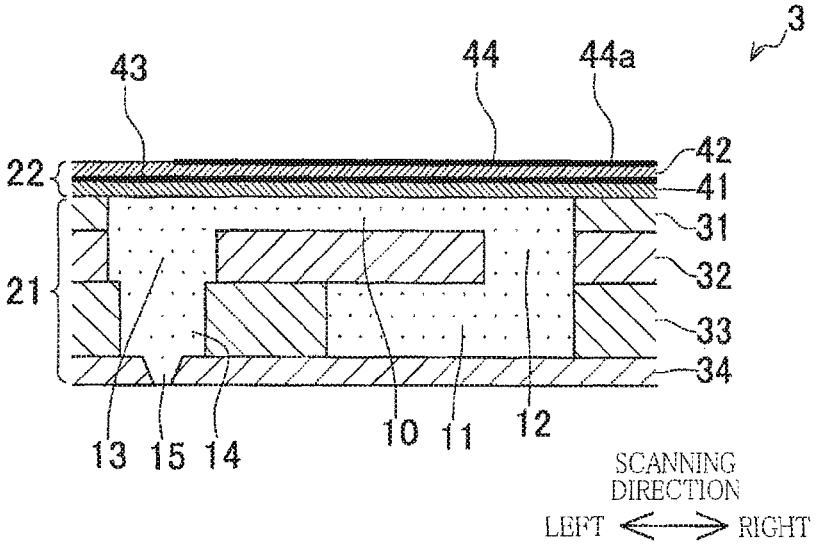
FIG. 3 is a cross-sectional view taken along line III-III in FIG. 2.

There will be next explained the ink-jet head 3. As illustrated in FIGS. 2 and 3, the ink-jet head 3 includes a passage unit 21 and a piezoelectric actuator 22. The passage unit 21 is constituted by four plates 31-34 stacked on each other. The plates 31-33 are formed of metal such as stainless steel. The plate 34 is formed of synthetic resin such as polyimide or formed of metal like the plates 31-33.

The plate 34 has the nozzles 15. The nozzles 15 are arranged in the conveying direction so as to form eight nozzle rows 16. Each adjacent two of the nozzle rows 16 are spaced apart from each other at a distance A in the scanning direction. In the following description, the even-numbered nozzle rows 16 from the left may be hereinafter referred to as "nozzle rows 16*b*", and the odd-numbered nozzle rows 16 from the left may be hereinafter referred to as "nozzle rows 16*a*". Each of the nozzles 15 of the nozzle rows 16*b* is located upstream of a corresponding one of the nozzles 15 of the nozzle rows 16*a* in the conveying direction by half the length of the distance between each two nozzles 15 in each of the nozzle rows 16. Black ink is ejected from the nozzles 15 of the first and second nozzle rows 16 from the left. Yellow ink is ejected from the nozzles 15 of the third and fourth nozzle rows 16 from the left. Cyan ink is ejected from the nozzles 15 of the fifth and sixth nozzle rows 16 from the left. Magenta ink is ejected from the nozzles 15 of the seventh and eighth nozzle rows 16 from the left.

The plate 31 has a multiplicity of pressure chambers 10. Each of the pressure chambers 10 has a substantially oval shape whose longitudinal direction coincides with the scanning direction. The pressure chambers 10 are formed for the respective nozzles 15. A left end portion of each of the pressure chambers 10 overlaps a corresponding one of the nozzles 15.

The plate 32 has a plurality of through holes 12 and a plurality of through holes 13 each having a substantially round shape. The through holes 12 are formed for the respective pressure chambers 10. Each of the through holes 12 overlaps a right end portion of a corresponding one of the pressure chambers 10. The through holes 13 are formed for the respective pressure chambers 10. Each of the through holes 13 overlaps a left end portion of a corresponding one of the pressure chambers 10.

The plate 33 has eight manifold passages 11. The eight manifold passages 11 correspond to the respective eight nozzle rows 16. Each of the manifold passages 11 extends in the conveying direction over the pressure chambers 10 for a corresponding one of the nozzle rows 16, and each of the manifold passages 11 overlaps a substantially right half of each pressure chamber 10. Downstream end portions of the first and second manifold passages 11 from the left in the conveying direction are connected to each other. Downstream end portions of the third and fourth manifold passages 11 from the left in the conveying direction are connected to each other. Downstream end portions of the fifth and sixth manifold passages 11 from the left in the conveying direction are connected to each other. Downstream end portions of the seventh and eighth manifold passages 11 from the left in the conveying direction are connected to each other. The ink is supplied to each two of the manifold passages 11 from a corresponding one of ink supply openings 17 which is formed at an area where the two manifold passages 11 are connected to each other. The plate 33 has a multiplicity of through holes 14 overlapping the respective through holes 13 and the respective nozzles 15.

The piezoelectric actuator 22 includes piezoelectric layers 41, 42, a common electrode 43, and individual electrodes 44. The piezoelectric layer 41 is formed of a piezoelectric material mainly composed of lead zirconate titanate. The piezoelectric layer 41 is disposed on an upper surface of the passage unit 21 so as to continuously extend over the pressure chambers 10. The piezoelectric layer 42 is formed of a piezoelectric material like the piezoelectric layer 41 and disposed on an upper surface of the piezoelectric layer 41. The common electrode 43 is disposed between the piezoelectric layer 41 and the piezoelectric layer 42 so as to continuously extend over the pressure chambers 10.

The common electrode 43 is always kept at ground potential. The individual electrodes 44 are provided for the respective pressure chambers 10 and disposed on an upper surface of the piezoelectric layer 42. Each of the individual electrodes 44 has a substantially oval shape in plan view which is one size smaller than a corresponding one of the pressure chambers 10. Each of the individual electrodes 44 overlaps a central portion of a corresponding one of the pressure chambers 10. A right end portion of each of the individual electrodes 44 in the scanning direction does not overlap the corresponding pressure chamber 10. A distal end portion of the right end portion serves as a connection terminal 44*a* for connection with a wiring member, not illustrated. Portions of the piezoelectric layer 42 which are sandwiched between the common electrode 43 and the individual electrodes 44 are polarized in the thickness direction of the piezoelectric layer 42.

Method of Driving Piezoelectric Actuator

There will be next explained a method of driving the piezoelectric actuator 22. In the piezoelectric actuator 22, all the individual electrodes 44 are kept at ground potential at first. When a pulsating drive signal such as an ejection signal or a slight vibration signal which will be described below is input to the individual electrode 44, the electric potential of the individual electrode 44 is switched to a predetermined driving electric potential of 20 V, for example. A potential difference between the individual electrode 44 and the common electrode 43 generates an electric field parallel to the polarization direction at a portion of the piezoelectric layer 42 between the individual electrode 44 and the common electrode 43. This electric field contracts the portion of the piezoelectric layer 42 in a planar direction to deform the piezoelectric layers 41, 42 such that the piezoelectric layers 41, 42 project toward the corresponding pressure chamber 10. This deformation reduces the volume of the pressure chambers 10, resulting in increase in pressure of ink in the pressure chamber 10. As a result, the ink is ejected from the nozzle 15 communicating with the pressure chamber 10, or a meniscus of the ink in the nozzle 15 is slightly vibrated.

Controller

Figure 4:
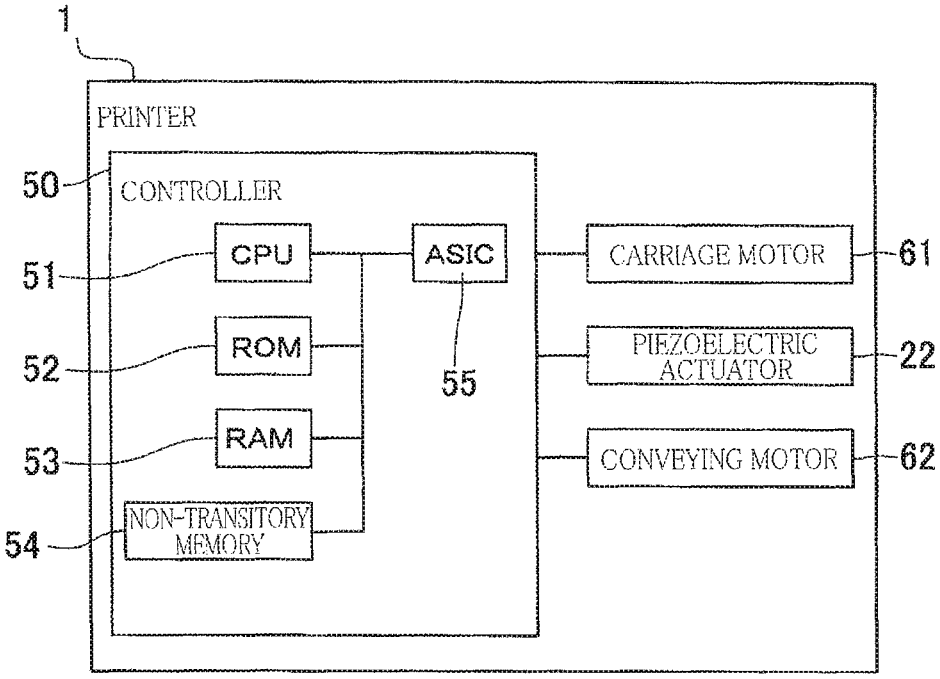
FIG. 4 is a block diagram illustrating a hardware configuration of the printer.

There will be next explained a controller 50 for controlling operations of the printer 1. As illustrated in FIG. 4, the controller 50 includes a central processing unit (CPU) 51, a read only memory (ROM) 52, a random access memory (RAM) 53, a non-transitory memory 54, and an application specific integrated circuit (ASIC) 55 which are cooperated to control operations of devices such as the carriage motor 61, the piezoelectric actuator 22, and the conveying motor 62.

The controller 50 includes the single CPU 51 in this embodiment as illustrated in FIG. 4, and this CPU 51 executes processings. However, the controller 50 may be a plurality of the CPUs 51, and the processings may be shared among the plurality of CPUs 51. Also, the controller 50 includes the single ASIC 55 in this embodiment as illustrated in FIG. 4, and this ASIC 55 executes processings. However, the controller 50 may be a plurality of the ASICs 55, and the processings may be shared among the plurality of ASICs 55.

Printing Method

There will be next explained control of the controller 50 for printing performed by the printer 1. For printing, the controller 50 drives the conveying motor 62 to rotate the conveying rollers 4*a*, 4*b* to convey the recording sheet P in the conveying direction. During this conveyance, the controller 50 drives the carriage motor 61 to reciprocate the carriage 2 in the scanning direction and drives the ink-jet head 3 to eject the ink. In the first embodiment, the control for printing will be explained by taking, as an example, what is called one-way printing in which the ink is ejected from the ink-jet head 3 only when the carriage 2 is moved rightward.

Figure 5:
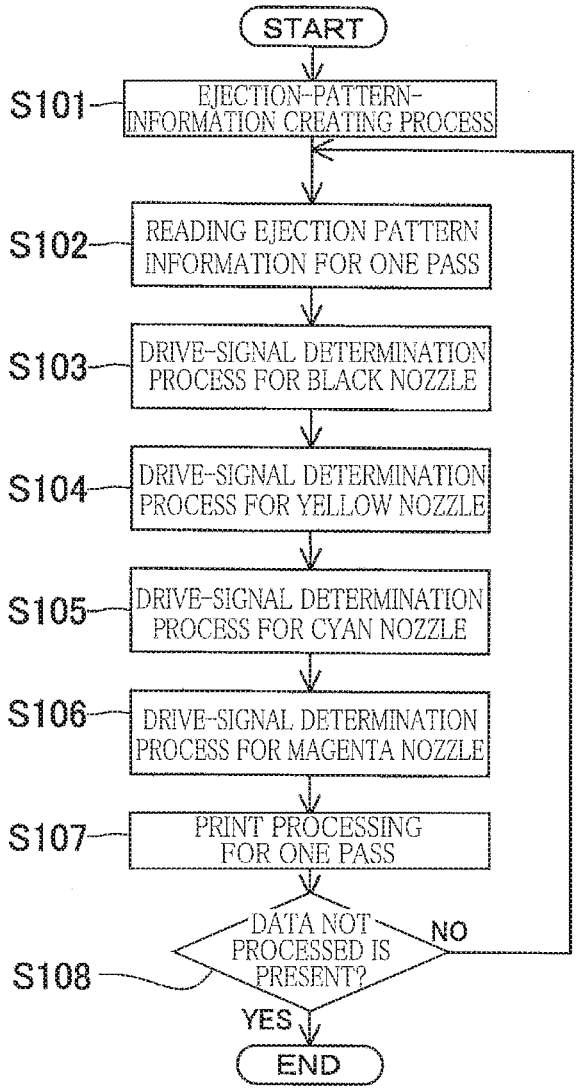
FIG. 5 is a flow chart illustrating processings for controlling the ink-jet head during printing in the first embodiment.
Figure 6A:
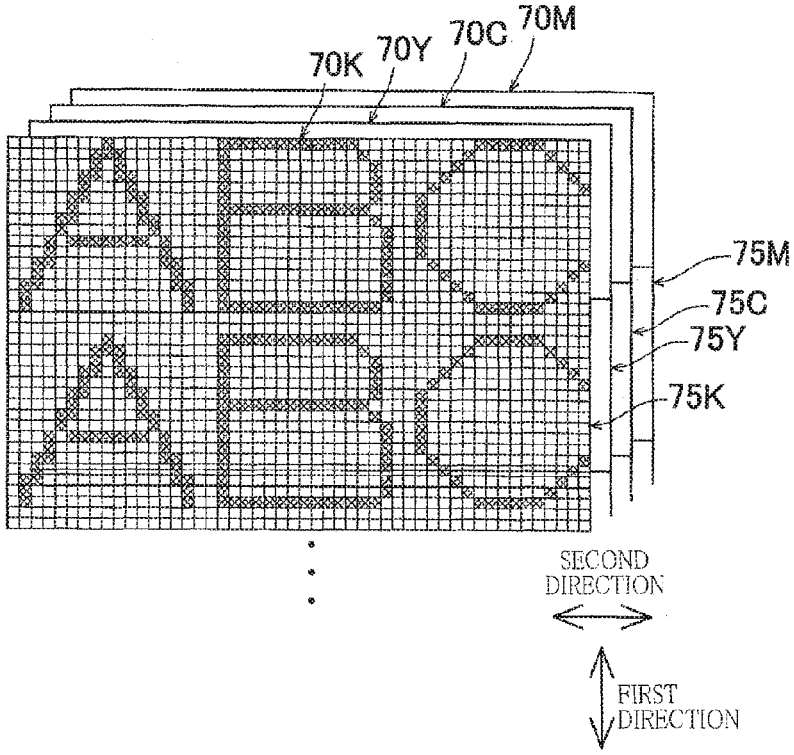
FIG. 6A is a view illustrating ejection pattern information in the first embodiment.
Figure 6B:
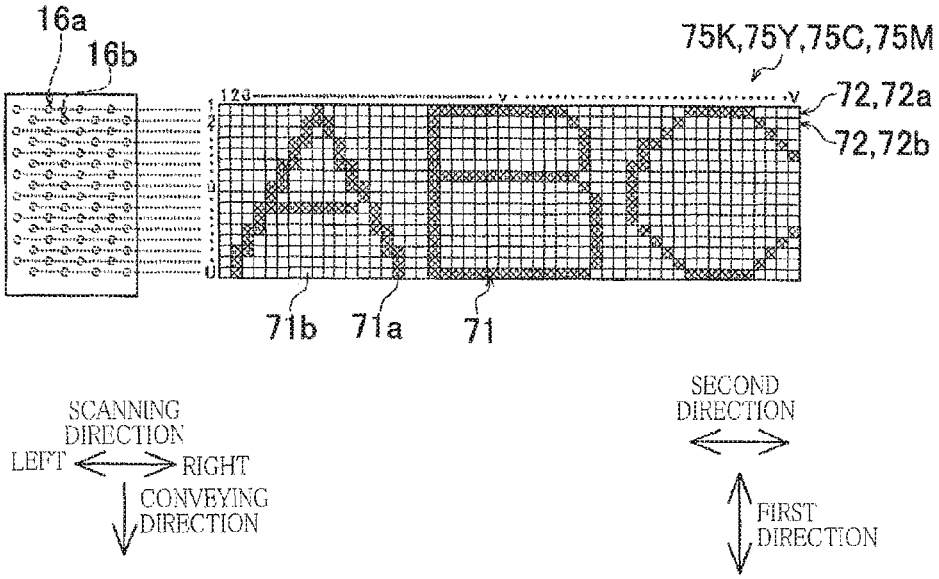
FIG. 6B is a view illustrating partial ejection pattern information and a relationship between nozzles and the ejection pattern information.
Figures 7A, 7B, 7C, 7D:
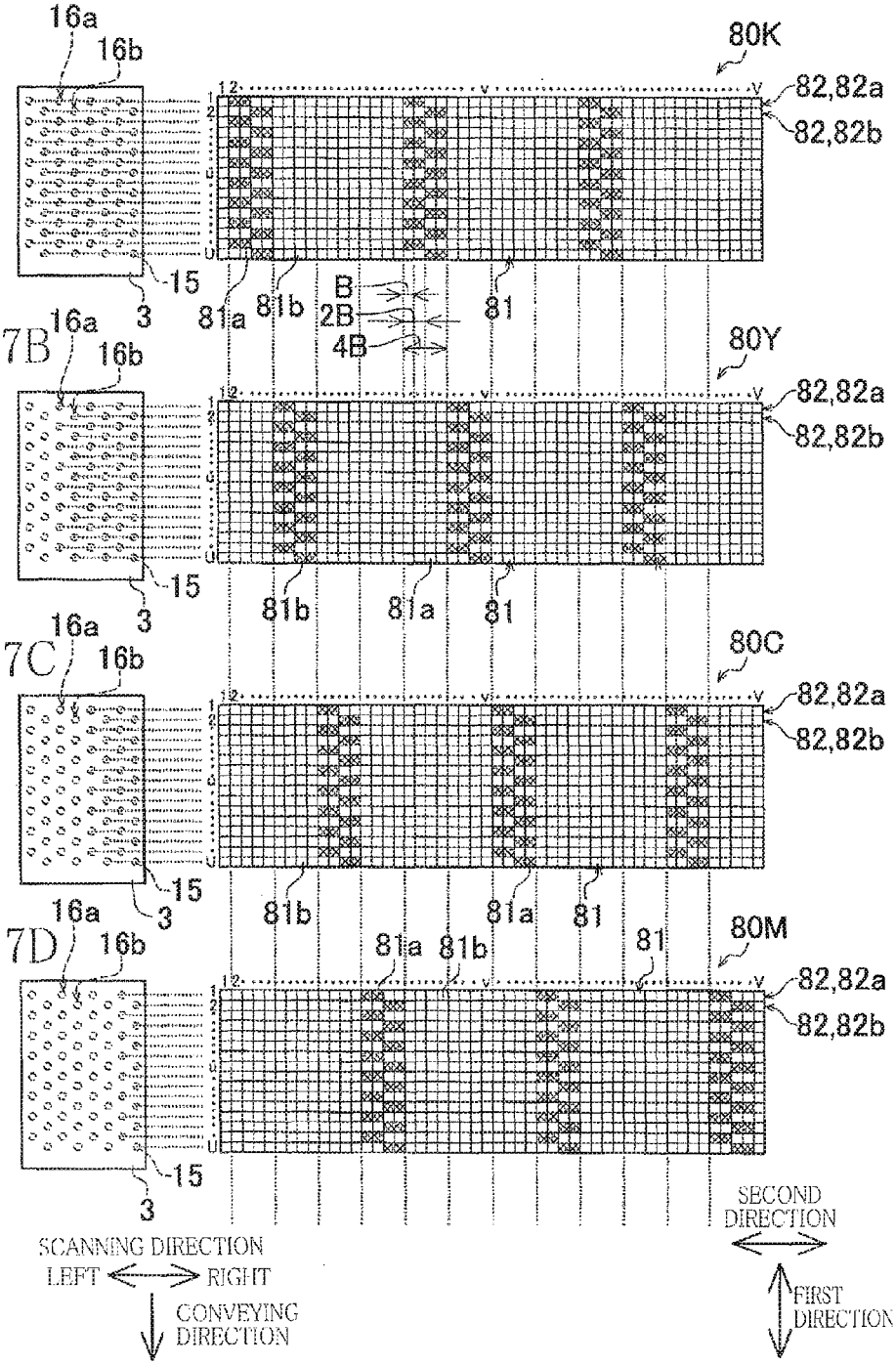
FIG. 7A is a view illustrating slight vibration pattern information relating to black and a relationship between the nozzles and the slight vibration pattern information.
FIG. 7B is a view illustrating slight vibration pattern information relating to yellow and a relationship between the nozzles and the slight vibration pattern information.
FIG. 7C is a view illustrating slight vibration pattern information relating to cyan and a relationship between the nozzles and the slight vibration pattern information.
FIG. 7D is a view illustrating slight vibration pattern information relating to magenta and a relationship between the nozzles and the slight vibration pattern information.

There will be next explained processings to be executed during printing in detail. To control the printer 1 to perform printing, the controller 50 executes a halftoning processing for image data which represents an arrangement of dots and is input from an external device, such as a PC, connected to the printer 1. As illustrated in FIG. 5, the controller 50 thereby at S101 executes an ejection-pattern-information creating process for creating four ejection pattern information (information sets) 70K, 70Y, 70C, 70M for the respective colors of the ink as illustrated in FIGS. 6A and 6B. The controller 50 stores the created ejection pattern information 70K, 70Y, 70C, 70M into the RAM 53. In the following description, the term "information" will be used for any one of a singular form and a plural form, in other words, the term "information" may represent any of a piece of information or a plurality of pieces of information.

Each of the ejection pattern information 70K, 70Y, 70C, 70M represents a two-dimensional pattern of a plurality of ejection information (information pieces) 71 in a first direction and a second direction perpendicular to each other. The ejection information 71 is any one of first information 71*a* indicating that the ink is to be ejected and second information 71*b* indicating that the ink is not to be ejected. In FIGS. 6A and 6B, the ejection information hatched is the first information 71*a*, and the ejection information not hatched is the second information 71*b*. The first direction corresponds to the conveying direction coinciding with a direction of arrangement of the nozzles 15 in each of the nozzle rows 16. The second direction corresponds to the scanning direction. In the first embodiment, it is assumed that only one kind of information is allocated as the first information 71*a* for easy understanding, but any one of a plurality of kinds of information may be selectively allocated as the first information 71*a*. For example, any one of three kinds of information may be selectively allocated as the first information 71*a*, and the three kinds of information may be information corresponding to a small ink droplet, information corresponding to a medium ink droplet, information corresponding to a large ink droplet.

As illustrated in FIGS. 6A and 6B, the ejection pattern information 70K is constituted by a plurality of partial ejection pattern information (information pieces) 75K. The ejection pattern information 70Y is constituted by a plurality of partial ejection pattern information 75Y. The ejection pattern information 70C is constituted by a plurality of partial ejection pattern information 75C. The ejection pattern information 70M is constituted by a plurality of partial ejection pattern information 75M. The partial ejection pattern information 75K, 75Y, 75C, 75M correspond to one pass (line) in the ejection pattern information 70K, 70Y, 70C, 70M. In each of the partial ejection pattern information 75K, 75Y, 75C, 75M, the V number of the ejection information 71 are arranged in the second direction in each of ejection information rows 72, and the U number of the ejection information rows 72 are arranged in the first direction.

In the following description, the u-th and v-th ejection information 71 respectively in the first direction and in the second direction in FIG. 6B may be hereinafter represented as the ejection information 71 at the position [u, v]. It is noted that the number u is a natural number less than or equal to U, and the number v is a natural number less than or equal to V. The ejection information 71 at the position [u, v] in the partial ejection pattern information 75K corresponds to the u-th nozzle 15 from the upstream side in the conveying direction among the nozzles 15 constituting the two nozzle rows 16*a*, 16*b* for ejecting the black ink. The ejection information 71 at the position [u, v] in the partial ejection pattern information 75Y corresponds to the u-th nozzle 15 from the upstream side in the conveying direction among the nozzles 15 constituting the two nozzle rows 16*a*, 16*b* for ejecting the yellow ink. The ejection information 71 at the position [u, v] in the partial ejection pattern information 75C corresponds to the u-th nozzle 15 from the upstream side in the conveying direction among the nozzles 15 constituting the two nozzle rows 16*a*, 16*b* for ejecting the cyan ink. The ejection information 71 at the position [u, v] in the partial ejection pattern information 75M corresponds to the u-th nozzle 15 from the upstream side in the conveying direction among the nozzles 15 constituting the two nozzle rows 16*a*, 16*b* for ejecting the magenta ink. The ejection information 71 at the position [u, v] in each of the partial ejection pattern information 75K, 75Y, 75C, 75M corresponds to the v-th cycle of driving (driving cycle) of the piezoelectric actuator 22.

The non-transitory memory 54 in advance stores four slight vibration pattern information 80K, 80Y, 80C, 80M for the respective colors as illustrated in FIGS. 7A-7D. Each of the slight vibration pattern information 80K, 80Y, 80C, 80M represents a two-dimensional pattern of a plurality of slight vibration information 81 in the first direction and the second direction. The slight vibration information 81 is any one of third information 81*a* indicating that the meniscus of the ink is to be vibrated and fourth information 81*b* indicating that the meniscus of the ink is not to be vibrated. In FIGS. 7A-7D, the slight vibration information 81 hatched is the third information 81*a*, and the slight vibration information 81 not hatched is the fourth information 81*b*.

In each of the slight vibration pattern information 80K, 80Y, 80C, 80M, the V number of the slight vibration information 81 are arranged in the second direction in each of slight vibration information rows 82, and the U number of the slight vibration information rows 82 are arranged in the first direction. In the following description, the u-th and v-th slight vibration information 81 respectively in the first direction and in the second direction in FIGS. 7A-7D in each of the slight vibration pattern information 80K, 80Y, 80C, 80M may be hereinafter represented as the slight vibration information 81 at the position [u, v].

The slight vibration information 81 at the position [u, v] in the slight vibration pattern information 80K corresponds to the u-th nozzle 15 from the upstream side in the conveying direction among the nozzles 15 constituting the two nozzle rows 16*a*, 16*b* for ejecting the black ink. The slight vibration information 81 at the position [u, v] in the slight vibration pattern information 80Y corresponds to the u-th nozzle 15 from the upstream side in the conveying direction among the nozzles 15 constituting the two nozzle rows 16*a*, 16*b* for ejecting the yellow ink. The slight vibration information 81 at the position [u, v] in the slight vibration pattern information 80C corresponds to the u-th nozzle 15 from the upstream side in the conveying direction among the nozzles 15 constituting the two nozzle rows 16*a*, 16*b* for ejecting the cyan ink. The slight vibration information 81 at the position [u, v] in the slight vibration pattern information 80M corresponds to the u-th nozzle 15 from the upstream side in the conveying direction among the nozzles 15 constituting the two nozzle rows 16*a*, 16*b* for ejecting the magenta ink. The slight vibration information 81 at the position [u, v] in each of the slight vibration pattern information 80K, 80Y, 80C, 80M corresponds to the v-th driving cycle for the piezoelectric actuator 22.

In the first embodiment, two of the third information 81*a* are arranged next to each other in the second direction in each of the slight vibration information rows 82 in each of the slight vibration pattern information 80K, 80Y, 80C, 80M. Specifically, three pairs of the two adjacent third information 81*a* are spaced apart from each other in the second direction.

In each of the slight vibration pattern information 80K, 80Y, 80C, 80M, the position of the third information 81*a* is different in the second direction between each odd-numbered slight vibration information row 82*a* from the top in the first direction in FIGS. 7A-7D (as one example of a slight vibration information row) and each even-numbered slight vibration information row 82*b* from the top in the first direction in FIGS. 7A-7D (as one example of a slight vibration information row). The third information 81*a* of the slight vibration information row 82*a* and the third information 81*a* of the slight vibration information row 82*b* are different in position from each other in the second direction and spaced apart from each other in the second direction at a distance 2B. Here, "B" corresponds to the driving cycle. An amount of movement of the carriage 2 when the carriage 2 is moved during a time corresponding to the distance 2B is equal to the distance A at which the nozzle row 16*a* and the nozzle row 16*b* adjacent to each other are spaced apart from each other.

The position of the third information 81*a* in the second direction is different among the slight vibration pattern information 80K, 80Y, 80C, 80M. The position of the third information 81*a* of the slight vibration pattern information 80K (as one example of first slight vibration pattern information corresponding to a first nozzle row) and the position of the third information 81*a* of the slight vibration pattern information 80Y (as one example of second slight vibration pattern information corresponding to a second nozzle row) are spaced apart from each other in the second direction at a distance 4B. The position of the third information of the slight vibration pattern information 80Y and the position of the third information of the slight vibration pattern information 80C are spaced apart from each other in the second direction at the distance 4B. The position of the third information of the slight vibration pattern information 80C and the position of the third information of the slight vibration pattern information 80M are spaced apart from each other in the second direction at the distance 4B. The position of the third information of the slight vibration pattern information 80M and the position of the third information of the slight vibration pattern information 80K are spaced apart from each other in the second direction at the distance 4B. An amount of movement of the carriage 2 when the carriage 2 is moved during a time corresponding to the distance 4B is equal to a distance 2A at which the first and third nozzle rows 16 from the left in the scanning direction are spaced apart from each other. Likewise, the third and fifth nozzle rows from the left in the scanning direction are spaced apart from each other at the distance 2A. Also, the fifth and seventh nozzle rows from the left in the scanning direction are spaced apart from each other at the distance 2A.

The third information 81*a* and the fourth information 81*b* are disposed in this arrangement in the slight vibration pattern information 80K, 80Y, 80C, 80M. Thus, when a slight vibration signal D2 which will be described below is transmitted to the piezoelectric actuator 22 based on the slight vibration pattern information 80K, 80Y, 80C, 80M, the slight vibration signals for all the nozzles 15 are transmitted in the same driving cycle. That is, the time intervals at which the meniscus of the liquid in each nozzle 15 in the two nozzle rows 16*a*, 16*b* for ejecting the black ink are slightly vibrated, the time intervals at which the meniscus of the liquid in each nozzle 15 in the two nozzle rows 16*a*, 16*b* for ejecting the yellow ink are slightly vibrated, the time intervals at which the meniscus of the liquid in each nozzle 15 in the two nozzle rows 16*a*, 16*b* for ejecting the cyan ink are slightly vibrated, and the time intervals at which the meniscus of the liquid in each nozzle 15 in the two nozzle rows 16*a*, 16*b* for ejecting the magenta ink are slightly vibrated are the same as each other.

Figure 8A:
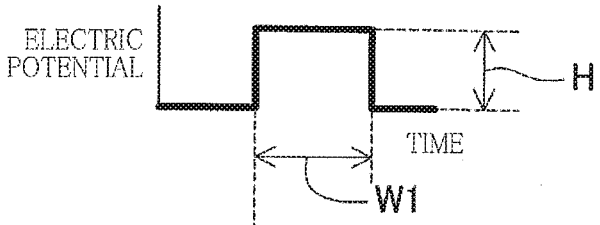
FIG. 8A is a view illustrating a waveform of an ejection signal.
Figure 8B:
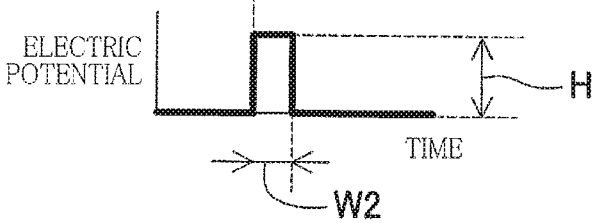
FIG. 8B is a view illustrating a waveform of a slight vibration signal.
Figure 8C:
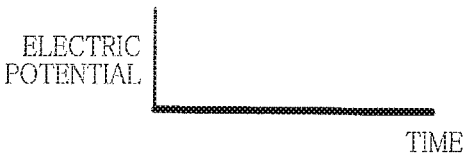
FIG. 8C is a view illustrating a waveform of a non-vibration signal.

After creation of data for the ejection pattern information 70K, 70Y, 70C, 70M at S101, the controller 50 at S102 reads the partial ejection pattern information 75K, 75Y, 75C, 75M. The controller 50 at S103-S106 determines a drive signal for one pass for each nozzle 15 in each driving cycle for the piezoelectric actuator 22 for each of the black, yellow, cyan, and magenta ink. The drive signal is any one of an ejection signal D1, the slight vibration signal D2, and a non-vibration signal D3. As illustrated in FIG. 8A, the ejection signal D1 is a signal containing a pulse with a pulse width of W1. As illustrated in FIG. 8B, the slight vibration signal D2 contains a pulse with a pulse width of W2 that is shorter than W1 and does not contain a pulse with a pulse width longer than W2. In each of the ejection signal D1 and the slight vibration signal D2, the height H of the pulse which indicates an electric potential is equal to the above-described driving electric potential. As illustrated in FIG. 8C, the non-vibration signal D3 is kept at ground potential.

Figure 9:
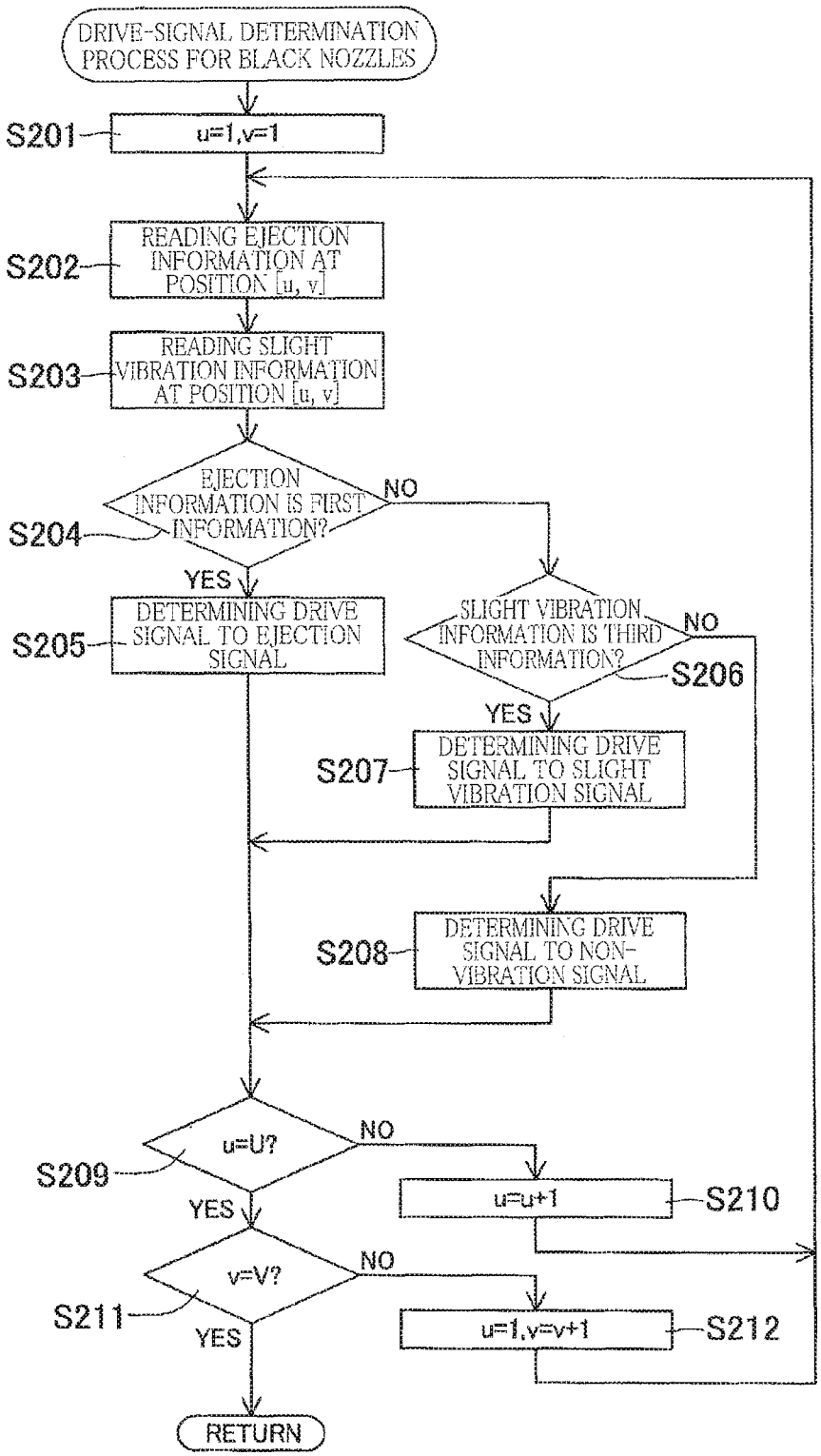
FIG. 9 is a flow chart illustrating a drive-signal determination process.

There will be next explained a drive-signal determination process for the nozzles 15 for the black ink at S103. It is noted that the nozzles 15 for the black ink may be hereinafter referred to as "black nozzles", and this applies to the nozzles 15 of the other colors. In the drive-signal determination process for the black nozzles at S103, as illustrated in FIG. 9, the controller 50 at S201 sets each of a variable u and a value v to one. The controller 50 at S202 reads the ejection information 71 at the position [u, v] from the partial ejection pattern information 75K of the ejection pattern information 70K. The controller 50 at S203 reads the slight vibration information 81 at the position [u, v] from the slight vibration pattern information 80K. When the read ejection information 71 is the first information 71*a* (S204: YES), the controller 50 at S205 determines a drive signal for the position [u, v] to the ejection signal D1 even when the read slight vibration information 81 is any of the third information 81*a* and the fourth information 81*b*, and this flow goes to S209.

When the read ejection information 71 is the second information 71*b* (S204: NO) and when the read slight vibration information 81 is the third information 81*a* (S206:

YES), the controller 50 at S207 determines the drive signal for the position [u, v] to the slight vibration signal D2, this flow goes to S209. When the read slight vibration information 81 is the fourth information 81*b* (S206: NO), the controller 50 at S208 determines the drive signal for the position [u, v] to the non-vibration signal D3, and this flow goes to S209.

Here, the drive signal for the position [u, v] which is determined at any of S205, S207, and S208 corresponds to the u-th nozzle 15 from the upstream side in the conveying direction among the nozzles 15 constituting the two nozzle rows 16*a*, 16*b* for ejecting the black ink. The slight vibration information 81 at the position [u, v] corresponds to the v-th driving cycle for the piezoelectric actuator 22.

After the drive signal for the position [u, v] is determined at any of 205, S207, and S208, when the value u is less than U (S209: NO), the controller 50 increments the value u by one, and this flow returns to S202. When the value u is equal to U, and the value v is less than V (S209: YES, S210: NO), the controller 50 at S212 sets the value u to one and increments the value v by one, and this flow returns to S202. When the value u is equal to U, and the value v is equal to V (S209: YES, S210: YES), this flow ends.

In the drive-signal determination process for the yellow nozzles at S104, the drive-signal determination process for the cyan nozzles at S105, and the drive-signal determination process for the magenta nozzles at S106, the controller 50 determines the drive signal for each position [u, v] as in the drive-signal determination process for the black nozzles at S103. When the processings at S103-S106 are executed, the drive signals are determined for one pass in all the driving cycles for the black, yellow, cyan, magenta ink.

The controller 50 at S107 executes a print processing for controlling the printer 1 to perform printing. In the print processing, the controller 50 moves the carriage 2 in the scanning direction and at the same time transmits the drive signals for one pass for each color which is determined at S103-S106, to the corresponding individual electrodes 44 in each driving cycle for the piezoelectric actuator 22. When the ejection pattern information 70K, 70Y, 70C, 70M include the partial ejection pattern information 75K, 75Y, 75C, 75M for which the processings at S102-S107 are not executed (S108: NO), the flow returns to S102. When the processings at S102-S107 are executed for all the partial ejection pattern information 75K, 75Y, 75C, 75M constituting the ejection pattern information 70K, 70Y, 70C, 70M (S108: YES), the flow ends.

In the first embodiment described above, the controller 50 determines the drive signals for respective positions for (i) the ejection information 71 of the partial ejection pattern information 75K, 75Y, 75C, 75M in the ejection pattern information 70K, 70Y, 70C, 70M and (ii) the slight vibration information 81 in the slight vibration pattern information 80K, 80Y, 80C, 80M, based on the ejection information 71 of the partial ejection pattern information 75K, 75Y, 75C, 75M in the ejection pattern information 70K, 70Y, 70C, 70M which are created based on image data and the slight vibration information 81 in the slight vibration pattern information 80K, 80Y, 80C, 80M which are stored in advance in the non-transitory memory 54.

This processing can easily determine the timing when the meniscus of the ink in each nozzle 15 is slightly vibrated, when compared with the case where the position of the third information 81*a* of the slight vibration pattern information 80K, 80Y, 80C, 80M is determined to be displaced leftward in the second direction from a position corresponding to the first information 71*a* in accordance with the position of the first information 71*a* of the created ejection pattern information 70K, 70Y, 70C, 70M, for example.

Also, when compared with the case where the meniscus of the ink in each nozzle 15 is always slightly vibrated except when the ink is ejected from the nozzles 15, it is possible to reduce increase in power consumption, heat generation of the ink-jet head 3, and deterioration of the piezoelectric actuator 22, for example.

In the first embodiment, the slight vibration pattern information 80K, 80Y, 80C, 80M for the respective colors, the third information 81*a* is different in position in the second direction between the slight vibration information rows 82*a*, 82*b* adjacent to each other in the first direction. As a result, the plurality of the third information 81*a* in the four slight vibration pattern information 80K, 80Y, 80C, 80M are arranged uniformly in the second direction.

Incidentally, characteristics of ink ejection from the nozzles 15 are different due to what is called cross talk between the case where the meniscus of the ink in each of the outer nozzles 15 is being slightly vibrated and the case where the meniscus is not vibrated. Thus, in the case where positions of the plurality of the third information 81*a* in the four slight vibration pattern information 80K, 80Y, 80C, 80M are the same as each other in the second direction, when the ink is ejected from the nozzles 15, two kinds of driving cycles appear: a driving cycle in which the meniscus of the ink in each of the other many nozzles 15 is slightly vibrated; and a driving cycle in which the meniscus of the ink in each of the other many nozzles 15 is not slightly vibrated. This case may cause inconsistencies in density between areas on a printed image in the scanning direction.

In the first embodiment, in contrast, the plurality of the third information 81*a* in the four slight vibration pattern information 80K, 80Y, 80C, 80M are arranged uniformly in the second direction as described above. With this configuration, the effects of the cross talk caused when the ink is ejected from the plurality of nozzles 15 onto each area on the recording sheet P are uniformed between the driving cycles. Accordingly, it is possible to reduce the inconsistencies in density on the printed image.

In the first embodiment, as described above, the slight vibration signals D2 are transmitted in the same driving cycle for all the nozzles 15. This transmission uniforms the effects of the cross talk caused when the meniscus of the ink in each nozzle 15 is slightly vibrated. As a result, an amount of vibration of the meniscus of the ink is the same among the nozzles 15, whereby the meniscus of the ink in each of the nozzles 15 can be slightly vibrated uniformly. Also, in this case, even when a signal that slightly vibrates the meniscus of the ink in each nozzle 15 as greatly as possible in a degree that does not cause ejection of the ink is used as the slight vibration signal, the ink is not ejected when the meniscus of the ink in another nozzle 15 is slightly vibrated using this signal. Accordingly, the meniscus of the ink in each nozzle 15 can be slightly vibrated as greatly as possible.

In the case where the effects of the cross talk caused when the meniscus of the ink is slightly vibrated are not uniform among the nozzles 15, unlike the first embodiment, the amount of the slight vibration of the meniscus of the ink is not uniform among the nozzles 15. Furthermore, from the viewpoint of preventing the ink from being ejected from the nozzle 15 when the meniscus of the ink is slightly vibrated, the slight vibration signal D2 needs to be created so as to suit the nozzles 15 with small effects of the cross talk. In this case, the meniscus of the ink in each nozzle 15 with large effects of the cross talk may not be slightly vibrated by a sufficient amount.

In the first embodiment, the printer 1 is one example of a liquid ejection apparatus. The ink-jet head 3 is one example of a liquid ejection head. Each of the portions of the piezoelectric actuator 22 which overlap the respective pressure chambers 10 is one example of an actuator. Each of the RAM 53 that stores the information of the ejection pattern information 70K, 70Y, 70C, 70M and the non-transitory memory 54 that stores the information of the slight vibration pattern information 80K, 80Y, 80C, 80M is one example of a storage.

The ejection information 71 at the position [u, v] is one example of ejection information at a first position, and the slight vibration information 81 at the position [u, v] is one example of slight vibration information at a second position which corresponds to the ejection information at the first position. The actuator provided for the nozzle 15 corresponding to the u-th ejection information rows 72 from the upper side in FIG. 6B among the above-described actuators is one example of an actuator corresponding to the first position.

Second Embodiment

Figure 10:
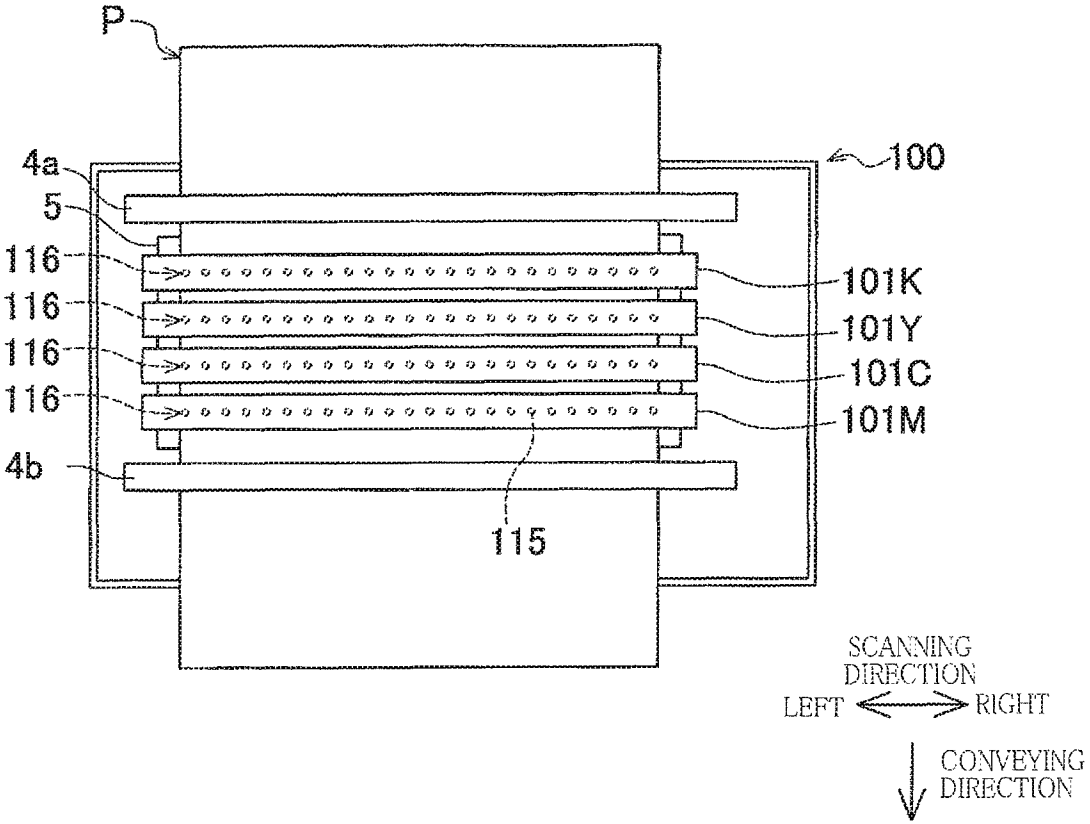
FIG. 10 is a schematic view of a printer according to a second embodiment.

There will be next explained a second embodiment. As illustrated in FIG. 10, a printer 100 according to the second embodiment includes four ink-jet heads 101K, 101Y, 101C, 101M instead of the carriage 2 and the ink-jet head 3 of the printer 1 according to the first embodiment. It is noted that the same reference numerals as used in the first embodiment are used to designate the corresponding elements of the second embodiment, and an explanation of which is dispensed with.

Each of the ink-jet heads 101K, 101Y, 101C, 101M is what is called a line head extending in the scanning direction throughout the entire length of the recording sheet P. The ink-jet heads 101K, 101Y, 101C, 101M are arranged in the conveying direction. Each of the ink-jet heads 101K, 101Y, 101C, 101M ejects ink from a multiplicity of nozzles 115 formed in a lower surface of the ink-jet head. The nozzles 115 of each of the ink-jet heads 101K, 101Y, 101C, 101M are arranged in the scanning direction so as to form a nozzle row 116. Each of the ink-jet heads 101K, 101Y, 101C, 101M ejects the ink of a corresponding one of black, yellow, cyan, and magenta.

Like the ink-jet head 3, each of the ink-jet heads 101K, 101Y, 101C, 101M includes a passage unit and a piezoelectric actuator. However, since the nozzles 15 are formed in different arrangements, the ink-jet heads 101K, 101Y, 101C, 101M are different from the ink-jet head 3 in arrangement and size of the ink passages such as the pressure chambers 10 and the manifold passages 11 and in arrangement and size of the piezoelectric layers 41, 42, the common electrode 43, and the plurality of individual electrodes 44.

In printing performed by the printer 100 according to the second embodiment, the controller 50 rotates the conveying rollers 4*a*, 4*b* to convey the recording sheet P in the conveying direction. During this conveyance, the controller 50 drives the ink-jet heads 101K, 101Y, 101C, 101M to record an image on the recording sheet P.

Figure 11:
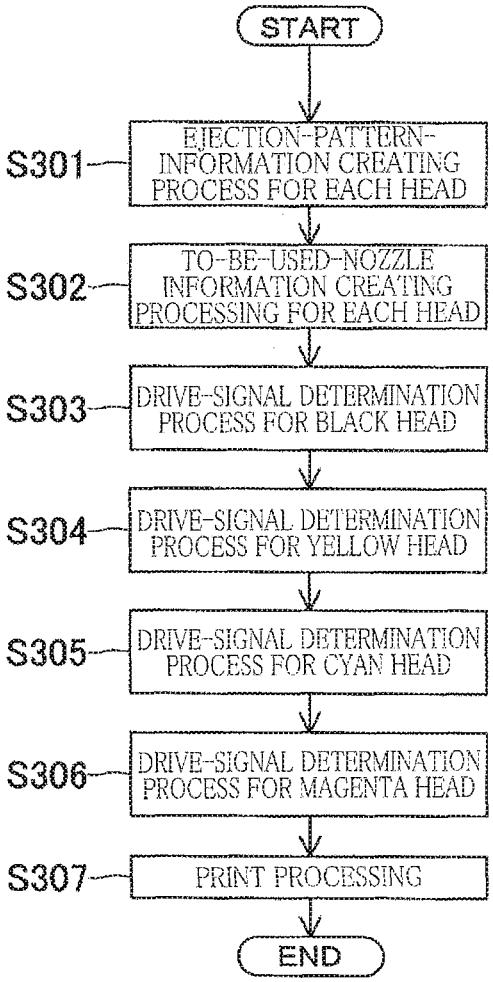
FIG. 11 is a flow chart illustrating processings for controlling the ink-jet head during printing in the second embodiment.
Figure 12:
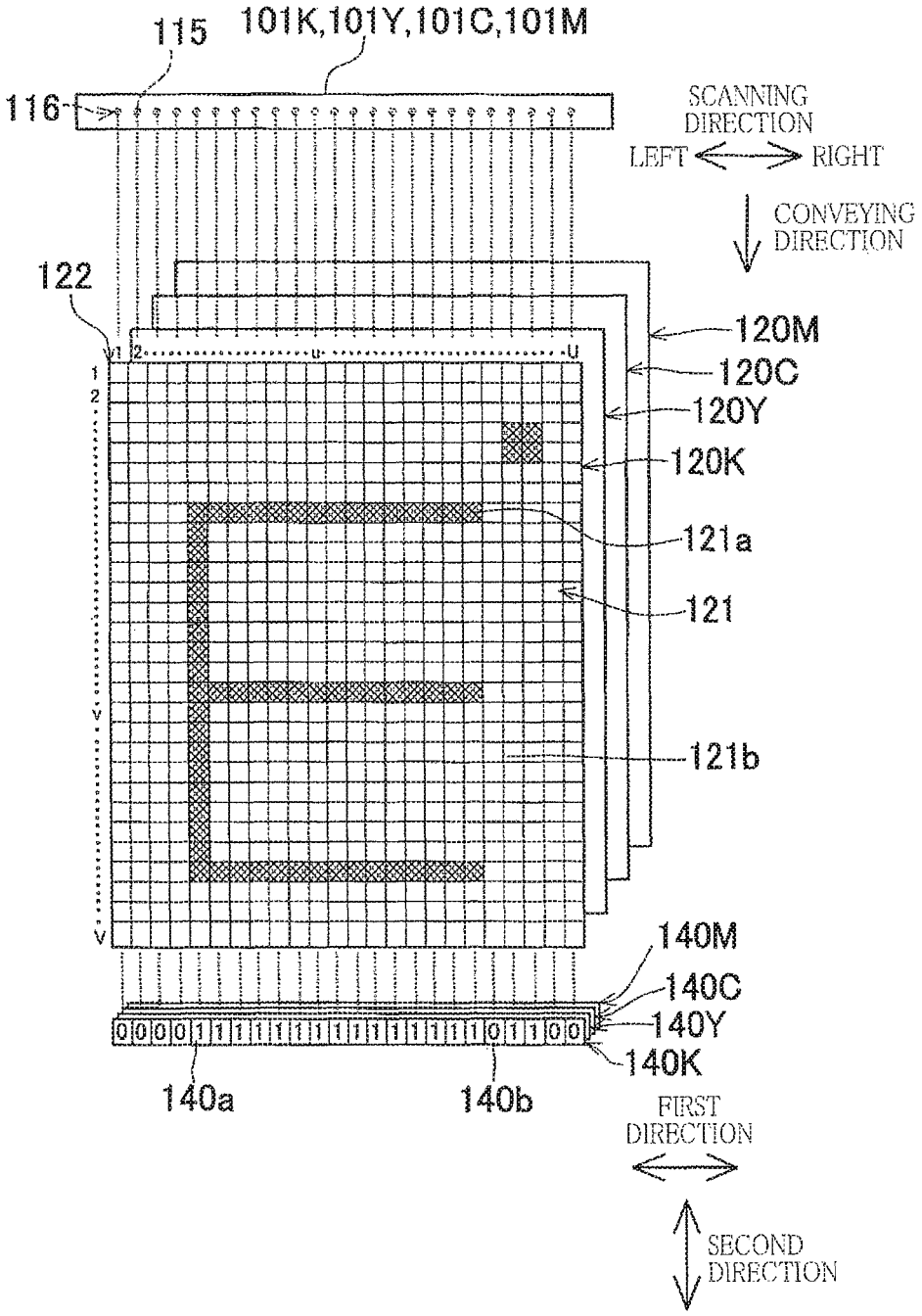
FIG. 12 is a view illustrating ejection pattern information in the second embodiment, a relationship between the nozzles and the ejection pattern information, and a relationship between ejection information rows and to-be-used-nozzle information.

There will be next explained processings to be executed during printing of the printer 100 in detail. To control the printer 100 to perform printing, the controller 50 executes a halftoning processing for image data input from an external device, such as a PC. As illustrated in FIG. 11, the controller 50 thereby at S301 executes the ejection-pattern-information creating process for creating four ejection pattern information 120K, 120Y, 120C, 120M for the respective ink-jet heads 101K, 101Y, 101C, 101M as illustrated in FIG. 12. The controller 50 stores the created ejection pattern information 120K, 120Y, 120C, 120M into the RAM 53. Each of the ejection pattern information 120K, 120Y, 120C, 120M represents a two-dimensional pattern of a plurality of ejection information 121 in the first direction and the second direction perpendicular to each other. The ejection information 121 is any one of first information 121*a* indicating that the ink is to be ejected and second information 121*b* indicating that the ink is not to be ejected. In FIG. 12, the ejection information 121 hatched is the first information 121*a*, and the ejection information 121 not hatched is the second information 121*b*.

The first direction corresponds to the scanning direction coinciding with a direction of arrangement of the nozzles 115 in the nozzle row 116. The second direction corresponds to the conveying direction. In each of the ejection pattern information 120K, 120Y, 120C, 120M, the V number of the ejection information 121 are arranged in the second direction in each of ejection information rows 122, and the U number of the ejection information rows 122 are arranged in the first direction. In the following description, the u-th and v-th ejection information 121 respectively from the left in FIG. 12 in the first direction and from the top in FIG. 12 in the second direction may be hereinafter represented as the ejection information 121 at the position [u, v]. It is noted that the number u is a natural number less than or equal to U, and the number v is a natural number less than or equal to V.

The ejection information 121 at the position [u, v] in the ejection pattern information 120K corresponds to the v-th driving cycle for the u-th nozzle 115 from the left in the scanning direction in the ink-jet head 101K. The ejection information 121 at the position [u, v] in the ejection pattern information 120Y corresponds to the v-th driving cycle for the u-th nozzle 115 from the left in the scanning direction in the ink-jet head 101Y. The ejection information 121 at the position [u, v] in the ejection pattern information 120C corresponds to the v-th driving cycle for the u-th nozzle 115 from the left in the scanning direction in the ink-jet head 101C. The ejection information 121 at the position [u, v] in the ejection pattern information 120M corresponds to the v-th driving cycle for the u-th nozzle 115 from the left in the scanning direction in the ink-jet head 101M.

Figure 13:
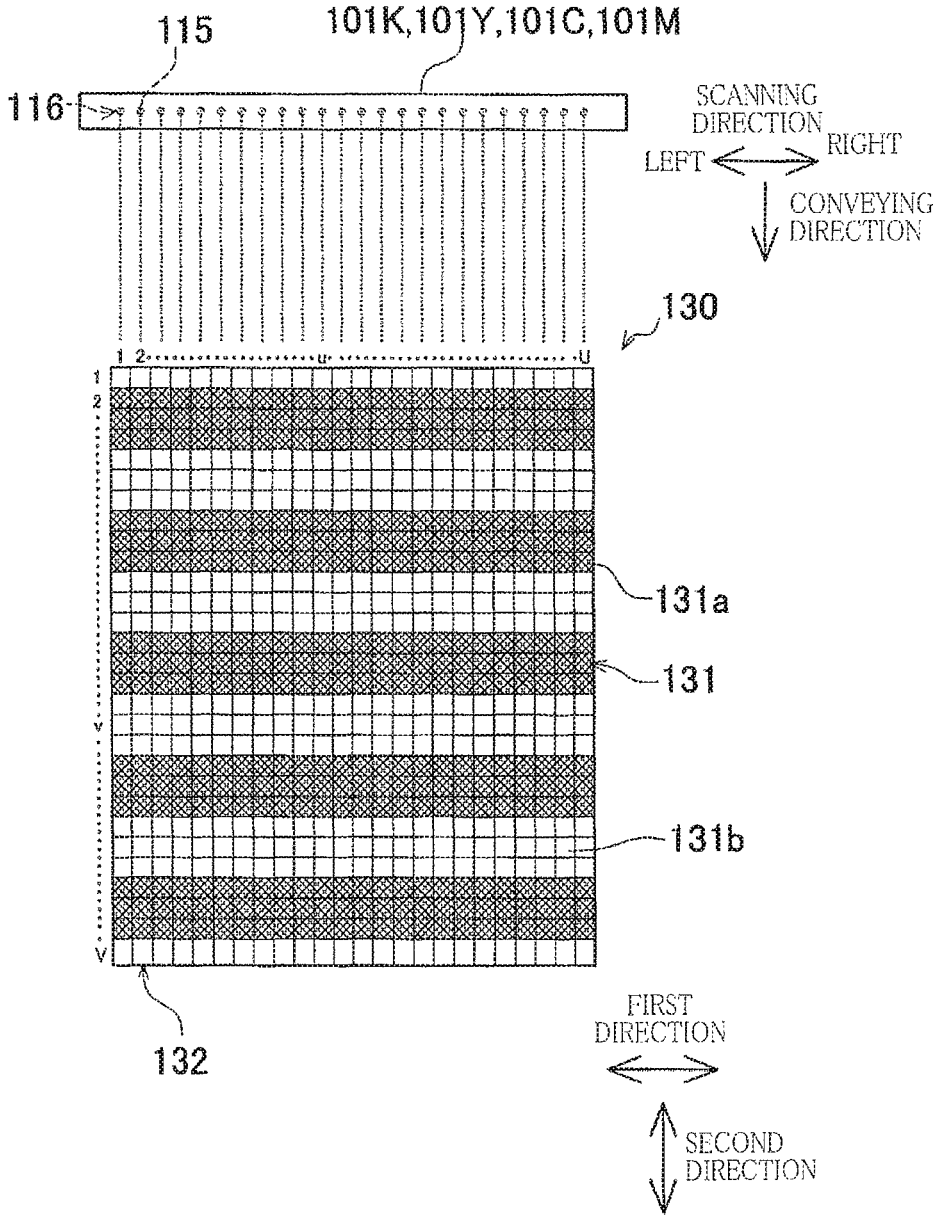
FIG. 13 is a view illustrating slight vibration pattern information in the second embodiment and a relationship between the nozzles and the slight vibration pattern information.

The non-transitory memory 54 in advance stores slight vibration pattern information 130 as illustrated in FIG. 13. It is noted that the slight vibration pattern information 130 in the second embodiment is used for all the four colors unlike the slight vibration pattern information 80K, 80Y, 80C, 80M in the first embodiment. The slight vibration pattern information 130 represents a two-dimensional pattern of a plurality of slight vibration information 131 in the first direction and the second direction. The slight vibration information 131 is any one of third information 131*a* indicating that the meniscus of the ink is to be slightly vibrated and fourth information 131*b* indicating that the meniscus of the ink is not to be slightly vibrated. In FIG. 13, the slight vibration information 131 hatched is the third information 131*a*, and the slight vibration information 131 not hatched is the fourth information 131*b*.

In the slight vibration pattern information 130, the V number of the slight vibration information 131 are arranged in the second direction in each of slight vibration information rows 132, and the U number of the slight vibration information rows 132 are arranged in the first direction. In the slight vibration pattern information 130, three third information 131*a* are arranged next to each other in the second direction, and three fourth information 131*b* are arranged next to each other in the second direction in each of the slight vibration information rows 132. The plurality of sets of the three third information 131*a* and the plurality of sets of the three fourth information 131*b* are alternately arranged in the second direction. In the slight vibration pattern information 130, the third information 131*a* and the fourth information 131*b* are disposed in the same arrangement in all the slight vibration information rows 132. In the following description, the u-th and v-th slight vibration information 131 respectively from the left in FIG. 13 in the first direction and from the top in FIG. 13 in the second direction may be hereinafter represented as the slight vibration information 131 at the position [u, v]. The slight vibration information 131 at the position [u, v] corresponds to the v-th driving cycle for the u-th nozzle 115 from the left in the scanning direction in each of the ink-jet heads 101K, 101Y, 101C, 101M.

After the ejection-pattern-information creating process at S301 for each of the ink-jet heads 101K, 101Y, 101C, 101M, the controller 50 at S302 creates to-be-used-nozzle information 140K, 140Y, 140C, 140M based on the ejection pattern information 120K, 120Y, 120C, 120M stored in the RAM 53. The to-be-used-nozzle information 140K is the information for each of the ejection information rows 122 of the ejection pattern information 120K. The to-be-used-nozzle information 140K is any one of fifth information 141*a* indicating that the ejection information row 122 contains at least one first information 121*a* and sixth information 141*b* indicating that the ejection information row 122 contains no first information 121*a*. In FIG. 12, the to-be-used-nozzle information 140K indicated by "1" is the fifth information 141*a*, and the to-be-used-nozzle information 140K indicated by "0" is the sixth information 141*b*.

The to-be-used-nozzle information 140Y is information for each of the ejection information rows 122 of the ejection pattern information 120Y. The to-be-used-nozzle information 140Y is any one of the fifth information 141*a* and the sixth information 141*b*. The to-be-used-nozzle information 140C is information for each of the ejection information rows 122 of the ejection pattern information 120C. The to-be-used-nozzle information 140C is any one of the fifth information 141*a* and the sixth information 141*b*. The to-be-used-nozzle information 140M is information for each of the ejection information rows 122 of the ejection pattern information 120M. The to-be-used-nozzle information 140M is any one of the fifth information 141*a* and the sixth information 141*b*.

The presence of at least one first information 121*a* in the ejection information row 122 indicates that corresponding at least one of the nozzles 115 is to be used for ink ejection during printing. The absence of the first information 121*a* in the ejection information row 122 indicates no nozzles 115 are to be used for ink ejection during printing.

The controller 50 at S303-S306 determines the drive signal for each nozzle 115 in each driving cycle for the piezoelectric actuator 22 for each of the black, yellow, cyan, and magenta ink based on the ejection pattern information 120K, 120Y, 120C, 120M created at S301, the slight vibration pattern information 130 stored in the non-transitory memory 54 in advance, and the to-be-used-nozzle information 140K, 140Y, 140C, 140M created at S302. As in the first embodiment, the drive signal is any one of the ejection signal D1, the slight vibration signal D2, and the non-vibration signal D3.

Figure 14:
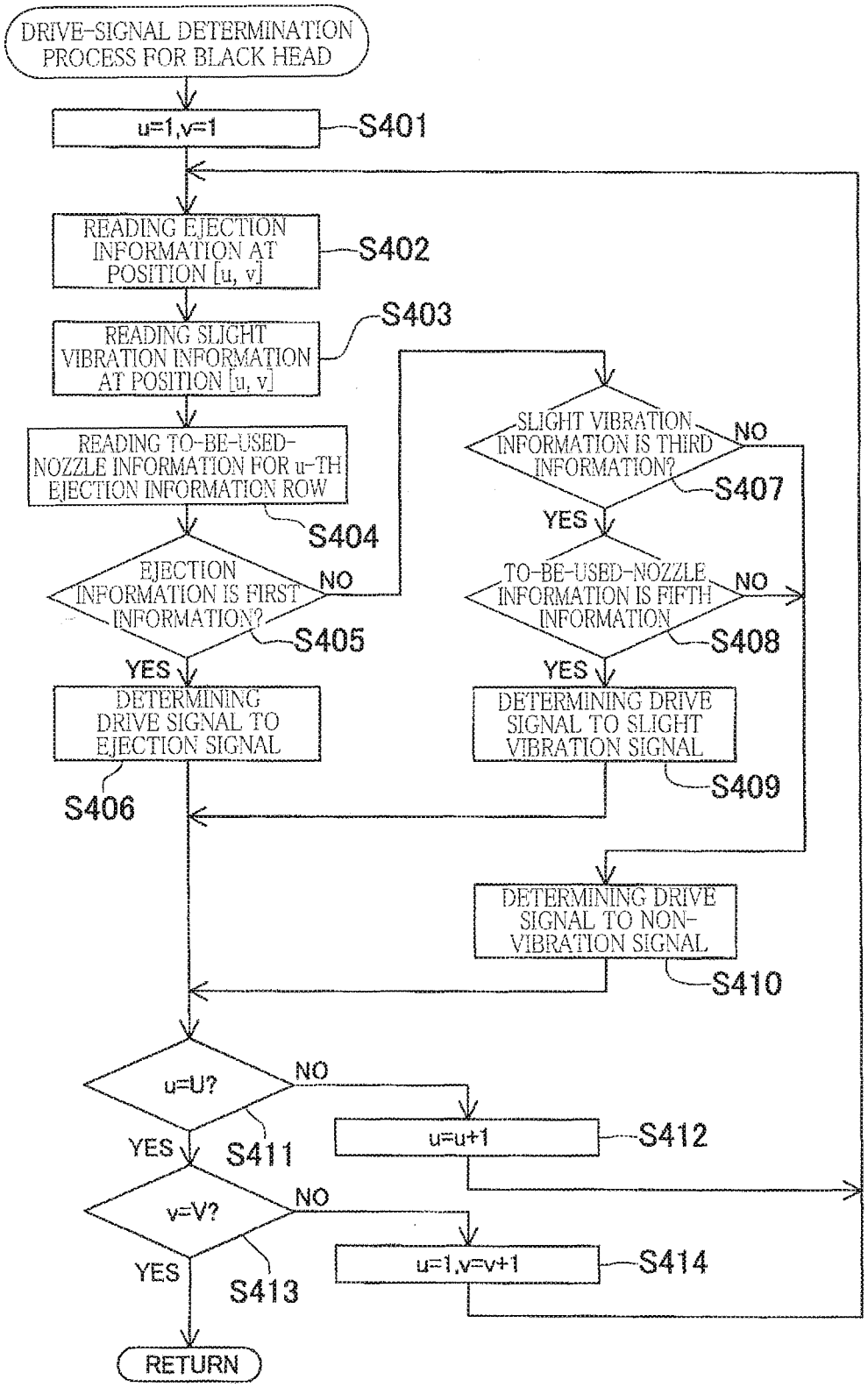
FIG. 14 is a flow chart illustrating a drive-signal determination process in the second embodiment.

In the drive-signal determination process for the black head at S303, as illustrated in FIG. 14, the controller 50 at S401 sets each of the values u, v to one. The controller 50 at S402 reads the ejection information 121 at the position [u, v] from the ejection pattern information 120K. The controller 50 at S403 reads the slight vibration information 131 at the position [u, v] from the slight vibration pattern information 130. The controller 50 at S404 reads the to-be-used-nozzle information 140K for the u-th ejection information row 122 from the left in the first direction in FIG. 12.

When the read ejection information 121 is the first information 121*a* (S405: YES), the controller 50 at S406 determines that the drive signal for the position [u, v] to the ejection signal D1 regardless of whether the read slight vibration information 131 is the third information 131*a* or the fourth information 131*b*, and this flow goes to S411. In this case, the to-be-used-nozzle information 140K read at S403 is fifth information 140*a*.

In the case where the read ejection information 121 is the second information 121*b* (S405: NO), when the read slight vibration information 131 is the third information 131*a* (S407: YES) and when the read to-be-used-nozzle information 140K is the fifth information 140*a* (S408: YES), the controller 50 at S409 determines the drive signal for the position [u, v] to the slight vibration signal D2, and this flow goes to S411.

Even in the case where the read ejection information 121 is the second information 121*b* (S405: NO), and the read slight vibration information 131 is the third information 131*a* (S407: YES), when the read to-be-used-nozzle information 140K is sixth information 140*b* (S408: NO), the controller 50 at S410 determines the drive signal for the position [u, v] to the non-vibration signal D3, and this flow goes to S409. When the read ejection information 121 is the second information 121*b* (S405: NO) and when the read slight vibration information 131 is the fourth information 131*b* (S407: NO), the controller 50 at S410 determines the drive signal for the position [u, v] to the non-vibration signal D3, and this flow goes to S411.

Here, the drive signal for the position [u, v] which is determined at any of S406, S409, and S410 is the drive signal for the u-th nozzle 15 of the ink-jet head 101K from the left in FIG. 10 in the v-th driving cycle.

After the drive signal for the position [u, v] is determined at any of S406, S409, and S410, when the value u is less than U (S411: NO), the controller 50 at S412 increments the value u by one (S412), and this flow returns to S402. When the value u is equal to U, and the value v is less than V (S411: YES, S413: NO), the controller 50 at S414 sets the value u to one and increments the value v by one, and this flow returns to S402. When the value u is equal to U, and the value v is equal to V (S411: YES, S413: YES), this flow ends.

As in the drive-signal determination process for the black head at S303, the controller 50 determines the drive signal for the position [u, v] in each of the drive-signal determination process for the yellow head at S304, the drive-signal determination process for the cyan head at S305, and the drive-signal determination process for the magenta head at S306. When the drive-signal determination processes at S303-S306 are executed, the drive signals are determined in all the driving cycles for the black, yellow, cyan, magenta ink.

The controller 50 at S307 executes a print processing by controlling the printer 100 to perform printing. In the print processing, the controller 50 controls the conveying rollers 4*a*, 4*b* to convey the recording sheet P and at the same time transmits the drive signals determined at S303-S306 to the corresponding individual electrodes 44 in each driving cycle for the piezoelectric actuator 22. Upon the completion of the print processing, the controller 50 terminates the flow.

In the second embodiment as described above, the drive signal is determined, for each of the positions at which the ejection information 121 of the ejection pattern information 120K, 120Y, 120C, 120M and the slight vibration information 131 of the slight vibration pattern information 130, based on the ejection pattern information 120K, 120Y, 120C, 120M created based on the image data and based on the slight vibration pattern information 130 stored in the non-transitory memory 54.

This processing can easily determine the timing when the meniscus of the ink in each nozzle 115 is slightly vibrated, when compared with the case where the position of the third information 131*a* of the slight vibration pattern information 130 is determined to be displaced upward in the second direction from a position corresponding to the first information 121*a* in accordance with the position of the first information 121*a* of the created ejection pattern information 120K, 120Y, 120C, 120M, for example.

Also, when compared with the case where the meniscus of the ink in each nozzle 115 is always slightly vibrated except when the ink is ejected from the nozzles 115, it is possible to reduce increase in power consumption, heat generation of the ink-jet head 3, and deterioration of the piezoelectric actuator 22, for example.

Incidentally, when the printer 100 performs image printing, no ink is ejected from the nozzles 115 of the ejection information rows 122 in which the to-be-used-nozzle information 140K, 140Y, 140C, 140M is the sixth information. In order to eliminate the increase in viscosity of the ink in the nozzles 115, the meniscus of the ink is slightly vibrated at the timing slightly before the timing when the ink is ejected from the nozzles 115, for example. If the meniscus of the ink is vibrated more than necessary, the viscosity of the ink in the nozzles 115 may increase on the contrary.

To solve this problem, in the second embodiment, even in the case where the read ejection information 121 is the second information 121*b*, and the read slight vibration information 131 is the third information 131*a*, when the read to-be-used-nozzle information 140K, 140Y, 140C, 140M is the sixth information 140*b*, the controller 50 determines the drive signal for the position to the non-vibration signal D3. With this determination, the meniscus of the ink in each nozzle 115 not used for ink ejection during printing performed by the printer 100 is not slightly vibrated. As a result, it is possible to prevent the meniscus of the ink in each nozzle 115 from being slightly vibrated more than necessary.

In the line head such as the ink-jet heads 101K, 101Y, 101C, 101M, the nozzles 115 overlaps opposite end portions (serving as margins) of the recording sheet P in the scanning direction are not used for ink ejection during printing in many cases. Accordingly, the processing for not slightly vibrating the meniscus of the ink in each nozzle 115 not used for ink ejection during printing is effective for the printer 100 including the line head.

The arrangement of the third information and the fourth information in the slight vibration pattern information is not limited to those in the first and second embodiments. For example, the distance in the second direction between the third information 81*a* of one of the four slight vibration pattern information 80K, 80Y, 80C, 80M and the third information 81*a* of another of the four slight vibration pattern information 80K, 80Y, 80C, 80M may differ from the distance 4B corresponding to the distance 2A at which the nozzle rows 16*a* are spaced apart from each other. The distance in the second direction between the position of the third information 81*a* in the slight vibration information row 82*a* and the position of the third information 81*a* in the slight vibration information row 82*b* in each of the slight vibration pattern information 80K, 80Y, 80C, 80M may differ from the distance 2B corresponding to the distance A at which the nozzle row 16*a* and the nozzle row 16*b* adjacent to each other are spaced apart from each other. In these cases, the driving cycles in which the slight vibration signals D2 are transmitted do not overlap between the nozzle rows 16.

While the embodiments have been described above, it is to be understood that the disclosure is not limited to the details of the illustrated embodiments, but may be embodied with various changes and modifications, which may occur to those skilled in the art, without departing from the spirit and scope of the disclosure.

First Modification

Figure 15:
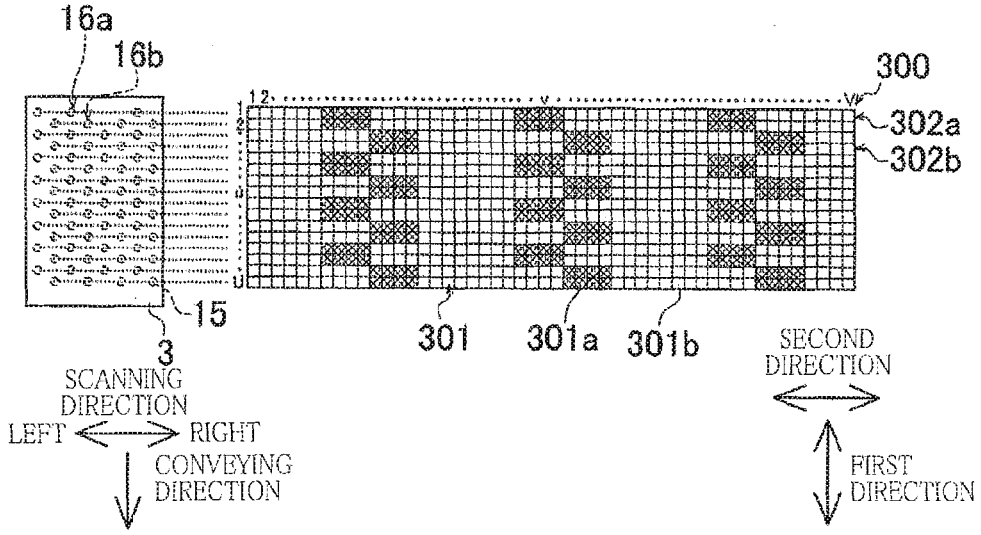
FIG. 15 is a view illustrating slight vibration pattern information in a first modification and a relationship between the nozzles and the slight vibration pattern information.

In a first modification, as illustrated in FIG. 15, slight vibration pattern information 300 is used for all the four colors. In the slight vibration pattern information 300, third information 301*a* do not overlap each other in position in the second direction between each of slight vibration information rows 302*a* containing the odd-numbered nozzles 15 (as another example of the first nozzle row) from the upstream side in the conveying direction among the nozzle rows 16 and each of slight vibration information rows 302*b* containing the even-numbered nozzles 15 (as another example of the second nozzle row) from the upstream side in the conveying direction among the nozzle rows 16. In this configuration, the driving cycles in which the slight vibration signals D2 are transmitted do not overlap between each two nozzles 15 adjacent to each other in the conveying direction in each of the nozzle rows 16.

Here, unlike the first modification, if the meniscuses of the ink are slightly vibrated at the same time in the two nozzles 15 adjacent to each other in the conveying direction, the cross talk reduces the amount of vibration of each meniscus of the ink, which may make it difficult to completely eliminate increase in viscosity of the ink in the nozzles 15. In the first modification, as described above, the driving cycles in which the slight vibration signals D2 are transmitted do not overlap between each two nozzles 15 adjacent to each other in the conveying direction in each of the nozzle rows 16. Accordingly, the effects of the cross talk are reduced when the meniscus of the ink in each nozzle 15 is slightly vibrated, making it possible to slightly vibrate the meniscus of the ink reliably.

Second Modification

Figure 16:
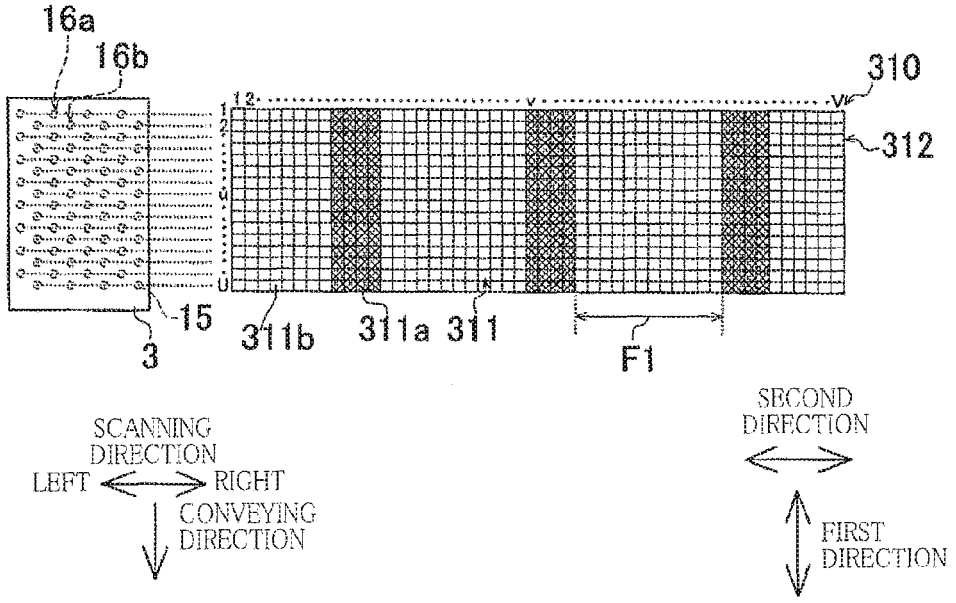
FIG. 16 is a view illustrating slight vibration pattern information in a second modification and a relationship between the nozzles and the slight vibration pattern information.

In a second modification, as illustrated in FIG. 16, slight vibration pattern information 310 is used for all the four colors. Third information 311*a* and fourth information 311*b* are located at the same positions in the second direction in all of slight vibration information rows 312.

In what is called a serial printer configured to perform printing by ejecting the ink from the ink-jet head 3 while moving the carriage 2 in the scanning direction as in the first embodiment, the carriage 2 is normally accelerated or decelerated in opposite end portions of its moving range and is moved at a fixed speed between the opposite end portions. In the first embodiment, however, the drive signal is determined without consideration of whether the carriage 2 is moved at the fixed speed, accelerated, or decelerated, but the present disclosure is not limited to this determination.

Third Modification

Figure 17:
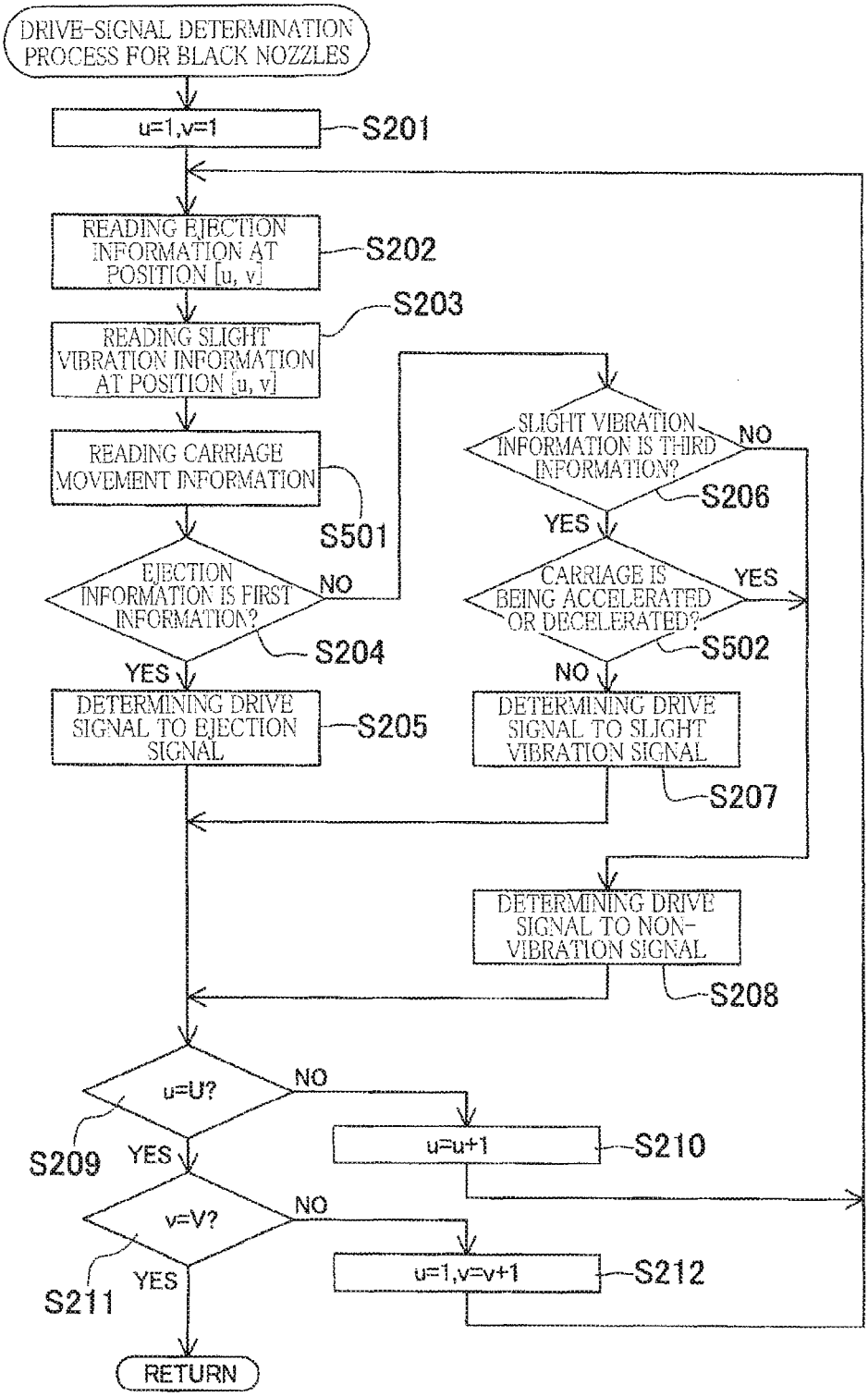
FIG. 17 is a flow chart corresponding to that in FIG. 9 in a third modification.

In the third modification, the non-transitory memory 54 in advance stores carriage movement information indicating areas in which the carriage 2 is moved in the scanning direction at the fixed speed, accelerated, and decelerated. In the drive-signal determination process at S103 in the third modification, as illustrated in FIG. 17, the controller 50 at S501 reads the carriage movement information in addition to reading the ejection information 71 and the slight vibration information 81 (S202, S203).

When the read ejection information 71 is the second information 71*b* (S204: NO), when the read slight vibration information 81 is the third information 81*a* (S206: YES), and when the carriage 2 is moved at the fixed speed (S502: NO), the controller 50 at S207 determines the drive signal to the slight vibration signal D2. When the carriage 2 is being accelerated or decelerated (S502: NO), the controller 50 at S208 determines the drive signal to the non-vibration signal D3.

While the carriage 2 is being accelerated or decelerated, the pressure of the ink in the ink-jet head 3 is unstable. Thus, when the meniscus of the ink in each nozzle 15 is slightly vibrated while the carriage 2 is being accelerated or decelerated, the ink may be unfortunately ejected from the nozzle 15 and adhere to the recording sheet P.

In the third modification, in contrast, even in the case where the read ejection information 71 is the second information 71*b*, and the read slight vibration information 81 is the third information 81*a*, when the carriage 2 is being accelerated or decelerated, the controller 50 determines the drive signal to the non-vibration signal D3. With this determination, the meniscus of the ink in each nozzle 15 is not slightly vibrated while the carriage 2 is being accelerated or decelerated, thereby preventing the ink from being ejected from the nozzle 15 when the meniscus of the ink is slightly vibrated.

The drive-signal determination process may be executed in a procedure different from that illustrated in FIG. 17 as long as the same result is obtained for the determination of the drive signal to any of the ejection signal D1, the slight vibration signal D2, and the non-vibration signal D3 for the ejection information 121 and the slight vibration information 131 at the position [u, v] and the carriage movement information.

Other Modifications

In the first to third modifications, the ink-jet head 3 may not include the plurality of the nozzle rows 16. In the first to third modifications, the ink-jet head 3 may include a single nozzle row 16.

In the first embodiment, the meniscus of the ink in each nozzle 15 is slightly vibrated regardless of whether the nozzle 15 is used or not for ink ejection for one pass, but the present disclosure is not limited to this configuration. In the first embodiment, the meniscus of the ink may not be slightly vibrated for the nozzles 15 not used for ink ejection for one pass.

In the second embodiment, the positions of the third information 131*a* and the fourth information 131*b* in the second direction are the same among all the slight vibration information rows 132 in the slight vibration pattern information 130, but the present disclosure is not limited to this configuration. In the second embodiment, the third information 131*a* may be different in position in the second direction among the slight vibration information rows 132.

In the second embodiment, the same slight vibration pattern information 130 is used for the four ink-jet heads 101K, 101Y, 101C, 101M (the four colors of the ink), but the present disclosure is not limited to this configuration. In the second embodiment, the non-transitory memory 54 may store a plurality of the slight vibration pattern information 130 different from each other for the respective ink-jet heads 101K, 101Y, 101C, 101M.

The procedure of the drive-signal determination process in the second embodiment is not limited to that illustrated in FIG. 14. The drive-signal determination process may be executed in a procedure different from that illustrated in FIG. 14 as long as the same result is obtained for the determination of the drive signal to any of the ejection signal D1, the slight vibration signal D2, and the non-vibration signal D3 for the ejection information 121, the slight vibration information 131, and the to-be-used-nozzle information. In the second embodiment, the meniscuses of the ink in all the nozzles 115 may be slightly vibrated regardless of the condition of whether the nozzle 115 is to be used at least once during printing.

Figure 18:
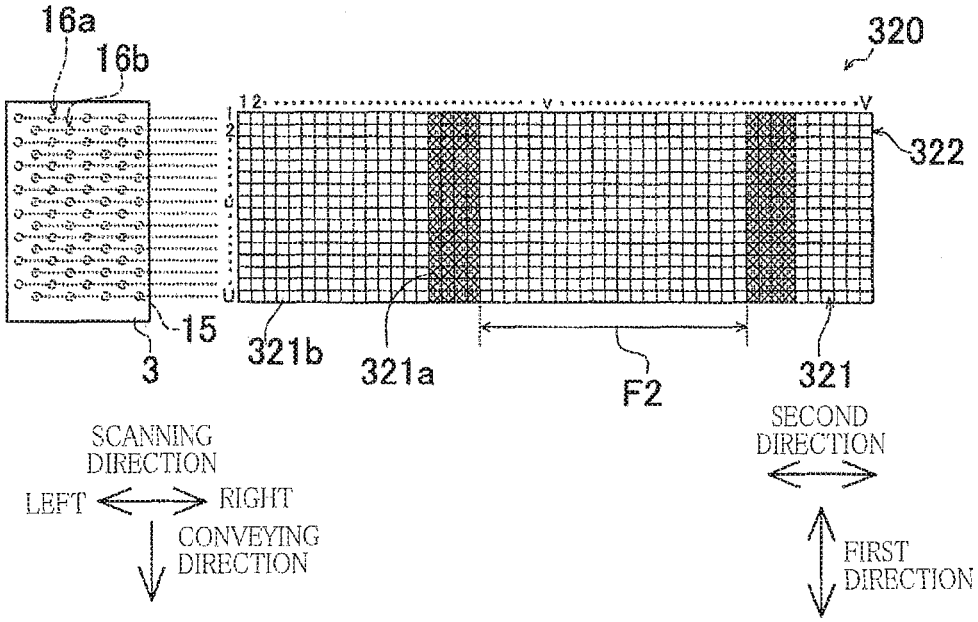
FIG. 18 is a view illustrating slight vibration pattern information in a fourth modification, which is different from that in FIG. 16, and a relationship between the nozzles and the slight vibration pattern information.

In the first and second embodiments, the drive signals are determined by always using the same slight vibration pattern information, but the present disclosure is not limited to this configuration. In a fourth modification, the non-transitory memory 54 stores (a) the slight vibration pattern information 310 as illustrated in FIG. 16 which is the same as that used in the second modification and (b) slight vibration pattern information 320 as illustrated in FIG. 18 which is different from the slight vibration pattern information 310. In the slight vibration pattern information 310, an area in which a plurality of the third information 311*a* are disposed and another area in which a plurality of the third information 311*a* are disposed are spaced apart from each other at a distance F1 in the second direction. In the slight vibration pattern information 320, an area in which a plurality of third information 321*a* are disposed and another area in which a plurality of the third information 321*a* are disposed are spaced apart from each other at a distance F2 in the second direction. This distance F2 is greater than the distance F1.

In this configuration, one of the slight vibration pattern information 310 and the slight vibration pattern information 320 can be selectively used when the controller 50 determines the drive signal. When the controller 50 determines the drive signal using the slight vibration pattern information 320, the meniscus of the ink in each nozzle 15 is slightly vibrated with a low frequency when compared with the case where the controller 50 determines the drive signal using the slight vibration pattern information 310. Accordingly, by switching the slight vibration pattern information to be used depending upon conditions relating to susceptibility of the increase in viscosity of the ink in the nozzles 15, the controller 50 can slightly vibrate the meniscus of the ink in each nozzle 15 with an appropriate frequency depending upon the conditions. That is, in the fifth modification, the controller 50 can slightly vibrate the meniscus of the ink in each nozzle 15 with an appropriate frequency by determining the drive signal using the slight vibration pattern information 310 when the viscosity of the ink in each nozzle 15 easily increases and determining the drive signal using the slight vibration pattern information 320 when it is difficult for the viscosity of the ink in each nozzle 15 to increase.

One example of the conditions relating to susceptibility of the increase in viscosity of the ink in the nozzles 15 is that the viscosity of the ink easily increases due to vaporization of water in the ink with increase in temperature of the ink the nozzles 15. As another example, the viscosity of the ink easily increases due to vaporization of water in the ink with decrease in humidity around the nozzles 15.

As still another example, the viscosity of the ink easily increases due to vaporization of water in the ink with increase in speed of movement of the carriage 2. As still another example, the viscosity of the ink easily increases with decrease in speed of ejection of the ink from the nozzle 15 because it is difficult for high-viscosity ink to be ejected.

As still another example, in the case where the printer 1 is capable of selectively performing one of (i) two-way printing in which the ink is ejected from the nozzles 15 to perform printing while the carriage 2 being reciprocated is being moved in any of both directions and (ii) one-way printing in which the ink is ejected from the nozzles 15 to perform printing while the carriage 2 being reciprocated is being moved in only one direction, the viscosity of the ink in the nozzles 15 increases more easily in the one-way printing than in the two-way printing because a length of time between ejection of the ink from the nozzle 15 and the next ejection of the ink from the nozzle 15 is longer in the one-way printing than in the two-way printing.

As still another example, in the case where the printer 1 performs printing by repeating pass of the ink-jet head ejecting the ink from the plurality of nozzles 15 while moving the carriage 2 in the scanning direction, the viscosity of the ink in the nozzle 15 easily increases with decrease in amount of ejection of the ink from the nozzle 15 in the preceding pass.

As still another example, flushing is in some constructions performed for discharging the ink from the nozzles 15 at a position not opposed to the recording sheet P just before the pass of the ink-jet head, and the viscosity of the ink in the nozzles 15 increases more easily in a pass in which the flushing is not performed just before the pass of the ink-jet head than in a pass in which the flushing is performed just before the pass of the ink-jet head.

As still another example, ink cartridges store the ink to be supplied to the ink-jet head 3, and the viscosity of the ink in the ink cartridges increases with increase in time elapsed from its mounting on the printer 1. Thus, the viscosity of the ink in the nozzles 15 increases more easily with increase in time elapsed from its mounting on the printer 1.

As still another example, the number of drivings of the piezoelectric actuator 22 increases with increase in the number of pages printed by the printer 1. The piezoelectric actuator 22 deteriorates with increase in the number of drivings and an amount of deformation in driving decreases. Thus, with increase in the number of pages printed by the printer 1, the amount of vibration of the meniscus of the ink in each nozzle 15 when the slight vibration signal D2 is transmitted to the individual electrode 44 decreases, and the viscosity of the ink in the nozzle 15 increases more easily.

As still another example, in the case where the printer 1 is a multi-function peripheral (MFP) further including a scanner for reading an image, the printer 1 is capable of selectively performing one of (i) normal printing which is printing based on image data input from an external device such as a PC and (ii) copying which is printing based on image data created based on reading performed by the scanner. In copying, heat is generated when the scanner is driven, and the generated heat heats the ink in the ink-jet head 3, so that the viscosity of the ink decreases. Thus, the viscosity of the ink in the nozzles 15 increases more easily in the normal printing than in the copying.

In the fourth modification, the non-transitory memory 54 stores the slight vibration pattern information 310, 320, but the present disclosure is not limited to this configuration. The non-transitory memory 54 may store three or more kinds of the slight vibration pattern information.

The slight vibration pattern information stored in the non-transitory memory 54 is not limited to the slight vibration pattern information itself and may be another kind of information which indicates a two-dimensional arrangement of the slight vibration information. For example, in the first embodiment, the non-transitory memory 54 may store information about a mathematical expression indicating a relationship between the position [u, v] and the slight vibration information 81. In this case, the controller 50 at S203 calculates the slight vibration information 81 at the position [u, v] based on the values u, v and the mathematical expression stored in the non-transitory memory 54 instead of reading the slight vibration information 81 stored in the non-transitory memory 54.

Figure 19A:
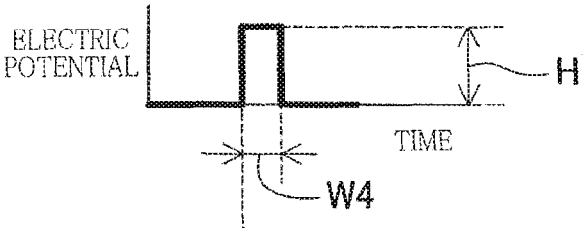
FIG. 19A is a view illustrating a waveform of a first slight vibration signal in a fifth modification.
Figure 19B:
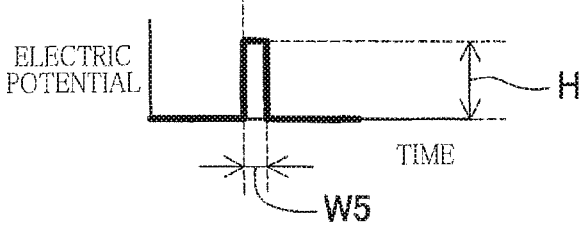
FIG. 19B is a view illustrating a waveform of a second slight vibration signal in a fifth modification, the view corresponding to that in FIG. 8B.
Figure 20:
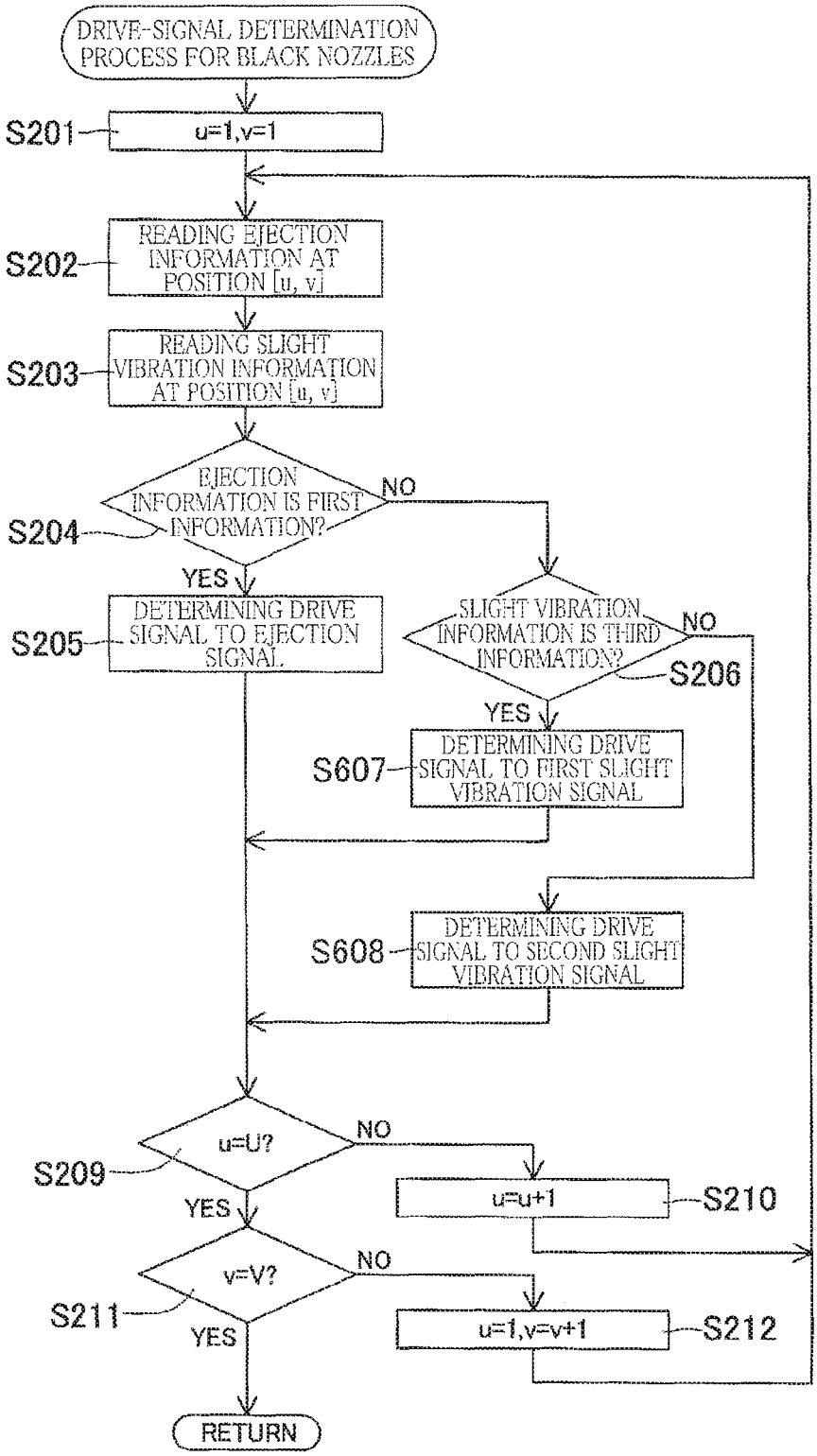
FIG. 20 is a flow chart illustrating a drive-signal determination process in a fifth modification.

In a fifth modification, the controller 50 may transmit, instead of the slight vibration signal D2, a first slight vibration signal D4 having a pulse with a pulse width of W4 as illustrated in FIG. 19A and transmit, instead of the non-vibration signal D3, a second slight vibration signal D5 having a pulse with a pulse width of W5 less than W4 and not having a pulse with a pulse width greater than W5 as illustrated in FIG. 19B. It is noted that the height of the pulse of each of the slight vibration signals D4, D5 is H like the slight vibration signal D2. In a drive-signal determination process in this modification, as illustrated in FIG. 20, when the ejection information is the first information, and the slight vibration information is the third information, the controller 50 at S607 determines the drive signal to the first slight vibration signal D4, and when the slight vibration information is the fourth information, the controller 50 at S608 determines the drive signal to the second slight vibration signal D5. The meniscus of the ink is slightly vibrated with a smaller amount of vibration in the nozzle 15 corresponding to the individual electrode 44 to which the second slight vibration signal D5 is transmitted than in the nozzle 15 corresponding to the individual electrode 44 to which the first slight vibration signal D4 is transmitted.

In this case, the meniscus of the ink in each nozzle 15 is always slightly vibrated except when the ink is ejected from the nozzle 15. In this case, however, it is possible to reduce the increase in power consumption, the heat generation of the ink-jet head 3, and the deterioration of the piezoelectric actuator 22, for example, when compared with the case where the first slight vibration signal D2 is always transmitted to the individual electrode 44 to slightly vibrate the meniscus of the ink in each nozzle 15 except when the ink is ejected from the nozzles 15.

While the present disclosure is applied to the printer configured to perform printing by ejecting the ink from the nozzles in the above-described embodiments, the present disclosure is not limited to this configuration. For example, the present disclosure may be applied to liquid ejection apparatuses other than the printer configured to perform printing by ejecting the ink from the nozzles.

What is claimed is:

1. A liquid ejection apparatus, comprising:

a liquid ejection head comprising a plurality of nozzles and a plurality of actuators respectively corresponding to the plurality of nozzles;

a storage configured to store ejection pattern information and slight vibration pattern information, the ejection pattern information indicating a two-dimensional arrangement of ejection information that is any one of first information and second information, the first information indicating that the liquid ejection head is to eject liquid from one of the plurality of nozzles, the second information indicating that the liquid ejection head is not to eject liquid from one of the plurality of nozzles, the slight vibration pattern information indicating a two-dimensional arrangement of slight vibration information that is any one of third information and fourth information, the third information indicating that a meniscus of the liquid is to be slightly vibrated, the fourth information indicating that the meniscus of the liquid is not to be slightly vibrated; and a controller configured to transmit one drive signal to at least one of the plurality of actuators among a plurality of kinds of drive signals based on the ejection pattern information and the slight vibration pattern information stored in the storage, the controller being configured to perform:

when the ejection information at a first position in the ejection pattern information is the first information and when the slight vibration information at a second position in the slight vibration pattern information is one of the third information and the fourth information, transmitting an ejection signal, for instructing ejection of the liquid, to a first actuator that is one of the plurality of actuators which corresponds to the first position, the second position being a position in the slight vibration pattern information which corresponds to the first position;

transmitting a slight vibration signal to the first actuator when the ejection information at the first position in the ejection pattern information is the second information and when the slight vibration information at the second position in the slight vibration pattern information is the third information, the slight vibration signal being a signal for instructing slight vibration of the meniscus of the liquid in one of the plurality of nozzles which corresponds to the second position; and transmitting a non-vibration signal to the first actuator when the ejection information at the first position in the ejection pattern information is the second information and when the slight vibration information at the second position in the slight vibration pattern information is the fourth information, the non-vibration signal being a signal for not instructing slight vibration of the meniscus of the liquid.

2. The liquid ejection apparatus according to claim 1, wherein the plurality of nozzles are arranged in at least one nozzle row extending in a nozzle-row direction, and wherein the storage is configured to store the ejection pattern information and the slight vibration pattern information each indicating a two-dimensional arrangement in a first direction corresponding to the nozzle-row direction and in a second direction perpendicular to the first direction.

3. The liquid ejection apparatus according to claim 2, wherein the plurality of nozzles are arranged in a plurality of nozzle rows that are provided for one color of the liquid and that are arranged in a direction perpendicular to the nozzle-row direction, wherein the slight vibration pattern information comprises a plurality of the slight vibration information arranged in a plurality of slight vibration information rows arranged in the first direction, and each of the plurality of slight vibration information rows extends in the second direction, and wherein the slight vibration information as the third information in the plurality of slight vibration information rows corresponding to a first nozzle row of the plurality of nozzle rows and the slight vibration information as the third information in the plurality of slight vibration information rows corresponding to a second nozzle row of the plurality of nozzle rows are different from each other in position in the second direction.

4. The liquid ejection apparatus according to claim 2, wherein the plurality of nozzles are arranged in a plurality of nozzle rows that are provided for a plurality of colors of the liquid and that are arranged in a direction perpendicular to the nozzle-row direction, wherein the slight vibration pattern information comprises a plurality of the slight vibration information arranged in a plurality of slight vibration information rows arranged in the first direction, and each of the plurality of slight vibration information rows extends in the second direction, and wherein the slight vibration information as the third information in the plurality of slight vibration information rows in first slight vibration pattern information corresponding to a first nozzle row of the plurality of nozzle rows and the slight vibration information as the third information in the plurality of slight vibration information rows in second slight vibration pattern information corresponding to a second nozzle row of the plurality of nozzle rows are different from each other in position in the second direction.

5. The liquid ejection apparatus according to claim 4, wherein the controller sets a position at which the slight vibration information is the third information, in each of ones of the plurality of slight vibration information rows which correspond to the first nozzle row and the second nozzle row, such that a time interval at which the meniscus of the liquid is slightly vibrated in each of ones of the plurality of nozzles in the first nozzle row and a time interval at which the meniscus of the liquid is slightly vibrated in each of ones of the plurality of nozzles in the second nozzle row are identical to each other.

6. The liquid ejection apparatus according to claim 2, wherein the slight vibration pattern information comprises a plurality of the slight vibration information arranged in a plurality of slight vibration information rows arranged in the first direction, and each of the plurality of slight vibration information rows extends in the second direction, and wherein the slight vibration information as the third information is different in position in the second direction between adjacent two of the plurality of slight vibration information rows.

7. The liquid ejection apparatus according to claim 2, wherein a plurality of the ejection information are arranged in a plurality of ejection information rows each extending in the second direction, and wherein the controller is configured to:

store to-be-used-nozzle information into the storage for each of the plurality of ejection information rows based on the ejection pattern information, the to-be-used-nozzle information being any one of fifth information and sixth information, the fifth information indicating that a corresponding one of the plurality of ejection information rows contain at least one first information each as the first information, the sixth information indicating that the corresponding one of the plurality of ejection information rows does not contain the first information; and transmit the non-vibration signal to the first actuator when the to-be-used-nozzle information for the corresponding one of the plurality of ejection information rows which contains the first position is the sixth information, even in the case where the ejection information at the first position in the ejection pattern information is the second information, and the slight vibration information at the second position in the slight vibration pattern information is the third information.

8. The liquid ejection apparatus according to claim 1, further comprising a carriage mounted on the liquid ejection head and movable in a scanning direction, wherein the controller is configured to transmit the non-vibration signal to the first actuator when the carriage is being accelerated or decelerated, even in the case where the ejection information at the first position in the ejection pattern information is the second information, and the slight vibration information at the second position in the slight vibration pattern information is the third information.

9. The liquid ejection apparatus according to claim 1, wherein the storage is configured to store a plurality of kinds of the slight vibration pattern information, wherein the controller is configured to:

select one of the plurality of kinds of the slight vibration pattern information; and transmit a drive signal to at least one of the plurality of actuators among the plurality of kinds of drive signals based on the selected one of the slight vibration pattern information and the ejection pattern information.

10. A liquid ejection apparatus, comprising:

a liquid ejection head comprising a plurality of nozzles and a plurality of actuators respectively corresponding to the plurality of nozzles;

a storage configured to store ejection pattern information and slight vibration pattern information, the ejection pattern information indicating a two-dimensional arrangement of ejection information that is any one of first information and second information, the first information indicating that the liquid ejection head is to eject liquid from one of the plurality of nozzles, the second information indicating that the liquid ejection head is not to eject liquid from one of the plurality of nozzles, the slight vibration pattern information indicating a two-dimensional arrangement of slight vibration information that is any one of third information and fourth information, the third information indicating that a meniscus of the liquid is to be slightly vibrated, the fourth information indicating that the meniscus of the liquid is not to be slightly vibrated; and a controller configured to transmit one drive signal to at least one of the plurality of actuators among a plurality of kinds of drive signals based on the ejection pattern information and the slight vibration pattern information stored in the storage, the controller being configured to perform:

when the ejection information at first position in the ejection pattern information is the first information and when the slight vibration information at second position in the slight vibration pattern information is one of the third information and the fourth information, transmitting an ejection signal, for instructing ejection of the liquid, to a first actuator that is one of the plurality of actuators which corresponds to the first position, the second position being a position in the slight vibration pattern information which corresponds to the first position;

transmitting a first slight vibration signal to the first actuator when the ejection information at the first position in the ejection pattern information is the second information and when the slight vibration information at the second position in the slight vibration pattern information is the third information, the first slight vibration signal being a signal for instructing slight vibration of the meniscus of the liquid in one of the plurality of nozzles which corresponds to the second position; and transmitting a second slight vibration signal to the first actuator when the ejection information at the first position in the ejection pattern information is the second information and when the slight vibration information at the second position in the slight vibration pattern information is the fourth information, the second slight vibration signal being a signal for slightly vibrating the meniscus of the liquid by a smaller amount than when the first slight vibration signal is transmitted.

* * * * *